US009105380B2

(12) United States Patent
Roberts et al.

(10) Patent No.: US 9,105,380 B2
(45) Date of Patent: Aug. 11, 2015

(54) MAGNETIC ATTACHMENT SYSTEM

(71) Applicant: Correlated Magnetics Research, LLC., Huntsville, AL (US)

(72) Inventors: Mark D. Roberts, Huntsville, AL (US); Larry W. Fullerton, New Hope, AL (US); Prentiss W. Haines, IV, Madison, AL (US); Hamilton G. Moore, Decatur, AL (US)

(73) Assignee: Correlated Magnetics Research, LLC., Huntsville, AL (US)

( * ) Notice: Subject to any disclaimer, the term of this patent is extended or adjusted under 35 U.S.C. 154(b) by 0 days.

(21) Appl. No.: 14/198,191

(22) Filed: Mar. 5, 2014

(65) Prior Publication Data

US 2014/0182088 A1 Jul. 3, 2014

Related U.S. Application Data

(63) Continuation-in-part of application No. 14/035,818, filed on Sep. 24, 2013, now Pat. No. 8,872,608, and a continuation-in-part of application No. 13/959,649, filed on Aug. 5, 2013, now Pat. No. 8,692,637, and a (Continued)

(51) Int. Cl.
*A44B 1/04* (2006.01)
*H01F 7/00* (2006.01)

(Continued)

(52) U.S. Cl.
CPC *H01F 7/00* (2013.01); *A41F 1/002* (2013.01); *A45C 13/1069* (2013.01); *A45F 5/02* (2013.01);

(Continued)

(58) Field of Classification Search
CPC ..... H01F 7/0252; H01F 7/0263; H01F 7/04; A44D 2203/00; A41F 1/002; A45C 13/1069; Y10T 7/0252; Y10T 24/32
See application file for complete search history.

(56) References Cited

U.S. PATENT DOCUMENTS 93,931 A 8/1869 Westcott
361,248 A 4/1887 Winton (Continued)

FOREIGN PATENT DOCUMENTS

CN 1615573 A 5/2005
DE 2938782 A1 4/1981

(Continued)

OTHER PUBLICATIONS

Atallah, K., Calverley, S.D., D. Howe, 2004, "Design, analysis and realisation of a high-performance magnetic gear", IEE Proc.-Electr. Power Appl., vol. 151, No. 2, Mar. 2004.

(Continued)

*Primary Examiner* — Ramon Barrera
(74) *Attorney, Agent, or Firm* — Vector IP Law Group; Robert S. Babayi

(57) ABSTRACT

An improved magnetic attachment system involves a female component that is associated with a first object and a male component that is associated with a second object. The female component includes a hole and a first magnetic structure having a first plurality of magnetic source regions having a first polarity pattern. The male component includes a peg that can be inserted into the hole and a second magnetic structure having a second plurality of magnetic source regions having a second polarity pattern complementary to said first polarity pattern. The male and female component are configured such that when the peg is inserted into the hole the first and second magnetic structures face each other across an interface boundary enabling magnetic attachment of the first object to the second object, where while the peg remains inserted within the hole the male component can be rotated relative to the female component but translational movement of the male component relative to the female component is constrained.

20 Claims, 18 Drawing Sheets

Related U.S. Application Data continuation-in-part of application No. 13/759,695, filed on Feb. 5, 2013, now Pat. No. 8,502,630, which is a continuation of application No. 13/841,554, filed on May 25, 2012, now Pat. No. 8,368,495, which is a continuation-in-part of application No. 13/351,203, filed on Jan. 16, 2012, now Pat. No. 8,314,671, said application No. 13/351,203 is a continuation of application No. 13/157,975, filed on Jun. 10, 2011, now Pat. No. 8,098,122, which is a continuation of application No. 12/952,391, filed on Nov. 23, 2010, now Pat. No. 7,961,069, which is a continuation of application No. 12/478,911, filed on Jun. 5, 2009, now Pat. No. 7,843,295, and a continuation of application No. 12/478,950, filed on Jun. 5, 2009, now Pat. No. 7,843,296, and a continuation of application No. 12/478,969, filed on Jun. 5, 2009, now Pat. No. 7,843,297, and a continuation of application No. 12/479,013, filed on Jun. 5, 2009, now Pat. No. 7,839,247, said application No. 12/478,950 is a continuation-in-part of application No. 12/476,952, filed on Jun. 2, 2009, now Pat. No. 8,179,219, said application No. 12/952,391 is a continuation-in-part of application No. 12/476,952, said application No. 12/478,969 is a continuation-in-part of application No. 12/476,952, said application No. 12/479,013 is a continuation-in-part of application No. 12/476,952, which is a continuation-in-part of application No. 12/322,561, filed on Feb. 4, 2009, now Pat. No. 8,115,581, which is a continuation-in-part of application No. 12/358,423, filed on Jan. 23, 2009, now Pat. No. 7,868,721, which is a continuation-in-part of application No. 12/123,718, filed on May 20, 2008, now Pat. No. 7,800,471.

(60) Provisional application No. 61/851,275, filed on Mar. 6, 2013, provisional application No. 61/744,342, filed on Sep. 24, 2012, provisional application No. 61/519,664, filed on May 25, 2011, provisional application No. 61/123,019, filed on Apr. 4, 2008.

(51) Int. Cl.

| | |
|---|---|
| ***H01F 7/02*** | (2006.01) |
| ***A41F 1/00*** | (2006.01) |
| ***H01F 7/04*** | (2006.01) |
| ***B42F 1/00*** | (2006.01) |
| ***B42F 1/06*** | (2006.01) |
| ***G09F 7/04*** | (2006.01) |
| ***A45F 5/02*** | (2006.01) |
| ***A45C 13/10*** | (2006.01) |

(52) U.S. Cl.

CPC . *A45F 5/022* (2013.01); *B42F 1/00* (2013.01); *B42F 1/06* (2013.01); *G09F 7/04* (2013.01); *H01F 7/0242* (2013.01); *H01F 7/0252* (2013.01); *H01F 7/0263* (2013.01); *H01F 7/04* (2013.01); *A44D 2203/00* (2013.01); *Y10T 24/32* (2015.01)

(56) References Cited

U.S. PATENT DOCUMENTS

| | | | |
|---|---|---|---|
| 381,968 | A | 5/1888 | Tesla |
| 493,858 | A | 3/1893 | Edison |
| 675,323 | A | 5/1901 | Clark |
| 687,292 | A | 11/1901 | Armstrong |
| 996,933 | A | 7/1911 | Lindquist |
| 1,081,462 | A | 12/1913 | Patton |
| 1,171,351 | A | 2/1916 | Neuland |
| 1,236,234 | A | 8/1917 | Troje |
| 1,252,289 | A | 1/1918 | Murray, Jr. |
| 1,301,135 | A | 4/1919 | Karasick |
| 1,312,546 | A | 8/1919 | Karasick |
| 1,323,546 | A | 8/1919 | Karasick |
| 1,554,236 | A | 1/1920 | Simmons |
| 1,343,751 | A | 6/1920 | Simmons |
| 1,624,741 | A | 12/1926 | Leppke et al. |
| 1,784,256 | A | 12/1930 | Stout |
| 1,895,129 | A | 1/1933 | Jones |
| 2,048,161 | A | 7/1936 | Klaiber |
| 2,147,482 | A | 12/1936 | Butler |
| 2,186,074 | A | 1/1940 | Koller |
| 2,240,035 | A | 4/1941 | Catherall |
| 2,243,555 | A | 5/1941 | Faus |
| 2,269,149 | A | 1/1942 | Edgar |
| 2,327,748 | A | 8/1943 | Smith |
| 2,337,248 | A | 12/1943 | Koller |
| 2,337,249 | A | 12/1943 | Koller |
| 2,389,298 | A | 11/1945 | Ellis |
| 2,401,887 | A | 6/1946 | Sheppard |
| 2,414,653 | A | 1/1947 | lokholder |
| 2,438,231 | A | 3/1948 | Schultz |
| 2,471,634 | A | 5/1949 | Vennice |
| 2,475,456 | A | 7/1949 | Norlander |
| 2,508,305 | A | 5/1950 | Teetor |
| 2,513,226 | A | 6/1950 | Wylie |
| 2,514,927 | A | 7/1950 | Bernhard |
| 2,520,828 | A | 8/1950 | Bertschi |
| 2,565,624 | A | 8/1951 | phelon |
| 2,570,625 | A | 10/1951 | Zimmerman et al. |
| 2,690,349 | A | 9/1954 | Teetor |
| 2,694,164 | A | 11/1954 | Geppelt |
| 2,964,613 | A | 11/1954 | Williams |
| 2,701,158 | A | 2/1955 | Schmitt |
| 2,722,617 | A | 11/1955 | Cluwen et al. |
| 2,770,759 | A | 11/1956 | Ahlgren |
| 2,837,366 | A | 6/1958 | Loeb |
| 2,853,331 | A | 9/1958 | Teetor |
| 2,888,291 | A | 5/1959 | Scott et al. |
| 2,896,991 | A | 7/1959 | Martin, Jr. |
| 2,932,545 | A | 4/1960 | Foley |
| 2,935,352 | A | 5/1960 | Heppner |
| 2,935,353 | A | 5/1960 | Loeb |
| 2,936,437 | A | 5/1960 | Fraser et al. |
| 2,962,318 | A | 11/1960 | Teetor |
| 3,055,999 | A | 9/1962 | Lucas |
| 3,089,986 | A | 5/1963 | Gauthier |
| 3,102,314 | A | 9/1963 | Alderfer |
| 3,151,902 | A | 10/1964 | Ahlgren |
| 3,204,995 | A | 9/1965 | Teetor |
| 3,208,296 | A | 9/1965 | Baermann |
| 3,238,399 | A | 3/1966 | Johanees et al. |
| 3,273,104 | A | 9/1966 | Krol |
| 3,288,511 | A | 11/1966 | Tavano |
| 3,301,091 | A | 1/1967 | Reese |
| 3,351,368 | A | 11/1967 | Sweet |
| 3,382,386 | A | 5/1968 | Schlaeppi |
| 3,408,104 | A | 10/1968 | Raynes |
| 3,414,309 | A | 12/1968 | Tresemer |
| 3,425,729 | A | 2/1969 | Bisbing |
| 3,468,576 | A | 9/1969 | Beyer et al. |
| 3,474,366 | A | 10/1969 | Barney |
| 3,500,090 | A | 3/1970 | Baermann |
| 3,521,216 | A | 7/1970 | Tolegian |
| 3,645,650 | A | 2/1972 | Laing |
| 3,668,670 | A | 6/1972 | Andersen |
| 3,684,992 | A | 8/1972 | Huguet et al. |
| 3,690,393 | A | 9/1972 | Guy |
| 3,696,258 | A | 10/1972 | Anderson et al. |
| 3,790,197 | A | 2/1974 | Parker |
| 3,791,309 | A | 2/1974 | Baermann |
| 3,802,034 | A | 4/1974 | Bookless |
| 3,803,433 | A | 4/1974 | Ingenito |
| 3,808,577 | A | 4/1974 | Mathauser |
| 3,836,801 | A | 9/1974 | Yamashita et al. |
| 3,845,430 | A | 10/1974 | Petkewicz et al. |
| 3,893,059 | A | 7/1975 | Nowak |

(56) References Cited

U.S. PATENT DOCUMENTS

| | | | |
|---|---|---|---|
| 3,976,316 | A | 8/1976 | Laby |
| 4,079,558 | A | 3/1978 | Gorham |
| 4,117,431 | A | 9/1978 | Eicher |
| 4,129,846 | A | 12/1978 | Yablochnikov |
| 4,209,905 | A | 7/1980 | Gillings |
| 4,222,489 | A | 9/1980 | Hutter |
| 4,296,394 | A | 10/1981 | Ragheb |
| 4,340,833 | A | 7/1982 | Sudo et al. |
| 4,352,960 | A | 10/1982 | Dormer et al. |
| 4,355,236 | A | 10/1982 | Holsinger |
| 4,399,595 | A | 8/1983 | Yoon et al. |
| 4,416,127 | A | 11/1983 | Gomez-Olea Naveda |
| 4,451,811 | A | 5/1984 | Hoffman |
| 4,453,294 | A | 6/1984 | Morita |
| 4,517,483 | A | 5/1985 | Hucker et al. |
| 4,535,278 | A | 8/1985 | Asakawa |
| 4,547,756 | A | 10/1985 | Miller et al. |
| 4,629,131 | A | 12/1986 | Podell |
| 4,645,283 | A | 2/1987 | MacDonald et al. |
| 4,680,494 | A | 7/1987 | Grosjean |
| 4,764,743 | A | 8/1988 | Leupold et al. |
| 4,808,955 | A | 2/1989 | Godkin et al. |
| 4,837,539 | A | 6/1989 | Baker |
| 4,849,749 | A | 7/1989 | Fukamachi et al. |
| 4,862,128 | A | 8/1989 | Leupold |
| H693 | H | 10/1989 | Leupold |
| 4,893,103 | A | 1/1990 | Leupold |
| 4,912,727 | A | 3/1990 | Schubert |
| 4,941,236 | A | 7/1990 | Sherman et al. |
| 4,956,625 | A | 9/1990 | Cardone et al. |
| 4,980,593 | A | 12/1990 | Edmundson |
| 4,993,950 | A | 2/1991 | Mensor, Jr. |
| 4,994,778 | A | 2/1991 | Leupold |
| 4,996,457 | A | 2/1991 | Hawsey et al. |
| 5,013,949 | A | 5/1991 | Mabe, Jr. |
| 5,020,625 | A | 6/1991 | Yamauchi et al. |
| 5,050,276 | A | 9/1991 | Pemberton |
| 5,062,855 | A | 11/1991 | Rincoe |
| 5,123,843 | A | 6/1992 | Van der Zel et al. |
| 5,179,307 | A | 1/1993 | Porter |
| 5,190,325 | A | 3/1993 | Doss-Desouza |
| 5,213,307 | A | 5/1993 | Perrillat-Amede |
| 5,302,929 | A | 4/1994 | Kovacs |
| 5,309,680 | A | 5/1994 | Kiel |
| 5,345,207 | A | 9/1994 | Gebele |
| 5,349,258 | A | 9/1994 | Leupold et al. |
| 5,367,891 | A | 11/1994 | Furuyama |
| 5,383,049 | A | 1/1995 | Carr |
| 5,394,132 | A | 2/1995 | Poil |
| 5,399,933 | A | 3/1995 | Tsai |
| 5,425,763 | A | 6/1995 | Stemmann |
| 5,440,997 | A | 8/1995 | Crowley |
| 5,461,386 | A | 10/1995 | Knebelkamp |
| 5,485,435 | A | 1/1996 | Matsuda et al. |
| 5,492,572 | A | 2/1996 | Schroeder et al. |
| 5,495,221 | A | 2/1996 | Post |
| 5,512,732 | A | 4/1996 | Yagnik et al. |
| 5,570,084 | A | 10/1996 | Ritter et al. |
| 5,582,522 | A | 12/1996 | Johnson |
| 5,604,960 | A | 2/1997 | Good |
| 5,631,093 | A | 5/1997 | Perry et al. |
| 5,631,618 | A | 5/1997 | Trumper et al. |
| 5,633,555 | A | 5/1997 | Ackermann et al. |
| 5,635,889 | A | 6/1997 | Stelter |
| 5,637,972 | A | 6/1997 | Randall et al. |
| 5,730,155 | A | 3/1998 | Allen |
| 5,742,036 | A | 4/1998 | Schramm, Jr. et al. |
| 5,759,054 | A | 6/1998 | Spadafore |
| 5,788,493 | A | 8/1998 | Tanaka et al. |
| 5,838,304 | A | 11/1998 | Hall |
| 5,852,393 | A | 12/1998 | Reznik et al. |
| 5,935,155 | A | 8/1999 | Humayun et al. |
| 5,956,778 | A | 9/1999 | Godoy |
| 5,983,406 | A | 11/1999 | Meyerrose |
| 6,000,484 | A | 12/1999 | Zoretich et al. |
| 6,039,759 | A | 3/2000 | Carpentier et al. |
| 6,047,456 | A | 4/2000 | Yao et al. |
| 6,072,251 | A | 6/2000 | Markle |
| 6,074,420 | A | 6/2000 | Eaton |
| 6,104,108 | A | 8/2000 | Hazelton et al. |
| 6,115,849 | A | 9/2000 | Meyerrose |
| 6,118,271 | A | 9/2000 | Ely et al. |
| 6,120,283 | A | 9/2000 | Cousins |
| 6,125,955 | A | 10/2000 | Zoretich et al. |
| 6,142,779 | A | 11/2000 | Siegel et al. |
| 6,170,131 | B1 | 1/2001 | Shin |
| 6,187,041 | B1 | 2/2001 | Garonzik |
| 6,188,147 | B1 | 2/2001 | Hazelton et al. |
| 6,205,012 | B1 | 3/2001 | Lear |
| 6,210,033 | B1 | 4/2001 | Karkos, Jr. et al. |
| 6,224,374 | B1 | 5/2001 | Mayo |
| 6,234,833 | B1 | 5/2001 | Tsai et al. |
| 6,241,069 | B1 | 6/2001 | Mazur et al. |
| 6,273,918 | B1 | 8/2001 | Yuhasz et al. |
| 6,275,778 | B1 | 8/2001 | Shimada et al. |
| 6,285,097 | B1 | 9/2001 | Hazelton et al. |
| 6,387,096 | B1 | 5/2002 | Hyde, Jr. |
| 6,422,533 | B1 | 7/2002 | Harms |
| 6,457,179 | B1 | 10/2002 | Prendergast |
| 6,467,326 | B1 | 10/2002 | Garrigus |
| 6,535,092 | B1 | 3/2003 | Hurley et al. |
| 6,540,515 | B1 | 4/2003 | Tanaka |
| 6,561,815 | B1 | 5/2003 | Schmidt |
| 6,599,321 | B2 | 7/2003 | Hyde, Jr. |
| 6,607,304 | B1 | 8/2003 | Lake et al. |
| 6,652,278 | B2 | 11/2003 | Honkura et al. |
| 6,653,919 | B2 | 11/2003 | Shih-Chung et al. |
| 6,720,698 | B2 | 4/2004 | Galbraith |
| 6,747,537 | B1 | 6/2004 | Mosteller |
| 6,821,126 | B2 | 11/2004 | Neidlein |
| 6,841,910 | B2 | 1/2005 | Gery |
| 6,842,332 | B1 | 1/2005 | Rubenson et al. |
| 6,847,134 | B2 | 1/2005 | Frissen et al. |
| 6,850,139 | B1 | 2/2005 | Dettmann et al. |
| 6,862,748 | B2 | 3/2005 | Prendergast |
| 6,864,773 | B2 | 3/2005 | Perrin |
| 6,913,471 | B2 | 7/2005 | Smith |
| 6,927,657 | B1 | 8/2005 | Wu |
| 9,636,937 | | 8/2005 | Tu et al. |
| 6,954,968 | B1 | 10/2005 | Sitbon |
| 6,971,147 | B2 | 12/2005 | Halstead |
| 7,009,874 | B2 | 3/2006 | Deak |
| 7,016,492 | B2 | 3/2006 | Pan et al. |
| 7,031,160 | B2 | 4/2006 | Tillotson |
| 7,033,400 | B2 | 4/2006 | Currier |
| 7,038,565 | B1 | 5/2006 | Chell |
| 7,065,860 | B2 | 6/2006 | Aoki et al. |
| 7,066,739 | B2 | 6/2006 | McLeish |
| 7,066,778 | B2 | 6/2006 | Kretzschmar |
| 7,097,461 | B2 | 8/2006 | Neidlein |
| 7,101,374 | B2 | 9/2006 | Hyde, Jr. |
| 7,135,792 | B2 | 11/2006 | Devaney et al. |
| 7,137,727 | B2 | 11/2006 | Joseph et al. |
| 7,186,265 | B2 | 3/2007 | Sharkawy et al. |
| 7,224,252 | B2 | 5/2007 | Meadow, Jr. et al. |
| 7,264,479 | B1 | 9/2007 | Lee |
| 7,276,025 | B2 | 10/2007 | Roberts et al. |
| 7,311,526 | B2 | 12/2007 | Rohrbach et al. |
| 7,339,790 | B2 | 3/2008 | Baker et al. |
| 7,344,380 | B2 | 3/2008 | Neidlein et al. |
| 7,351,066 | B2 | 4/2008 | DiFonzo et al. |
| 7,358,724 | B2 | 4/2008 | Taylor et al. |
| 7,362,018 | B1 | 4/2008 | Kulogo et al. |
| 7,364,433 | B2 | 4/2008 | Neidlein |
| 7,381,181 | B2 | 6/2008 | Lau et al. |
| 7,402,175 | B2 | 7/2008 | Azar |
| 7,416,414 | B2 | 8/2008 | Bozzone et al. |
| 7,438,726 | B2 | 10/2008 | Erb |
| 7,444,683 | B2 | 11/2008 | Prendergast et al. |
| 7,453,341 | B1 | 11/2008 | Hildenbrand |
| 7,467,948 | B2 | 12/2008 | Lindberg et al. |
| 7,498,914 | B2 | 3/2009 | Miyashita et al. |
| 7,583,500 | B2 | 9/2009 | Ligtenberg et al. |
| 7,637,746 | B2 | 12/2009 | Lindberg et al. |

(56) References Cited

U.S. PATENT DOCUMENTS

| | | | |
|---|---|---|---|
| 7,645,143 | B2 | 1/2010 | Rohrbach et al. |
| 7,658,613 | B1 | 2/2010 | Griffin et al. |
| 7,715,890 | B2 | 5/2010 | Kim et al. |
| 7,762,817 | B2 | 7/2010 | Ligtenberg et al. |
| 7,775,567 | B2 | 8/2010 | Ligtenberg et al. |
| 7,796,002 | B2 | 9/2010 | Hashimoto et al. |
| 7,799,281 | B2 | 9/2010 | Cook et al. |
| 7,808,349 | B2 | 10/2010 | Fullerton et al. |
| 7,812,697 | B2 | 10/2010 | Fullerton et al. |
| 7,817,004 | B2 | 10/2010 | Fullerton et al. |
| 7,828,556 | B2 | 11/2010 | Rodrigues |
| 7,832,897 | B2 | 11/2010 | Ku |
| 7,837,032 | B2 | 11/2010 | Smeltzer |
| 7,839,246 | B2 | 11/2010 | Fullerton et al. |
| 7,843,297 | B2 | 11/2010 | Fullerton et al. |
| 7,868,721 | B2 | 1/2011 | Fullerton et al. |
| 7,871,272 | B2 | 1/2011 | Firman, II et al. |
| 7,874,856 | B1 | 1/2011 | Schriefer et al. |
| 7,889,037 | B2 | 2/2011 | Cho |
| 7,901,216 | B2 | 3/2011 | Rohrbach et al. |
| 7,903,397 | B2 | 3/2011 | McCoy |
| 7,905,626 | B2 | 3/2011 | Shantha et al. |
| 7,997,906 | B2 | 8/2011 | Ligtenberg et al. |
| 8,002,585 | B2 | 8/2011 | Zhou |
| 8,009,001 | B1 | 8/2011 | Cleveland |
| 8,050,714 | B2 | 11/2011 | Fadell et al. |
| 8,078,224 | B2 | 12/2011 | Fadell et al. |
| 8,078,776 | B2 | 12/2011 | Novotney et al. |
| 8,087,939 | B2 | 1/2012 | Rohrbach et al. |
| 8,099,964 | B2 | 1/2012 | Saito et al. |
| 8,138,869 | B1 | 3/2012 | Lauder et al. |
| 8,143,982 | B1 | 3/2012 | Lauder et al. |
| 8,143,983 | B1 | 3/2012 | Lauder et al. |
| 8,165,634 | B2 | 4/2012 | Fadell et al. |
| 8,177,560 | B2 | 5/2012 | Rohrbach et al. |
| 8,187,006 | B2 | 5/2012 | Rudisill et al. |
| 8,190,205 | B2 | 5/2012 | Fadell et al. |
| 8,242,868 | B2 | 8/2012 | Lauder et al. |
| 8,253,518 | B2 | 8/2012 | Lauder et al. |
| 8,264,310 | B2 | 9/2012 | Lauder et al. |
| 8,264,314 | B2 | 9/2012 | Sankar |
| 8,271,038 | B2 | 9/2012 | Fadell et al. |
| 8,271,705 | B2 | 9/2012 | Novotney et al. |
| 8,297,367 | B2 | 10/2012 | Chen et al. |
| 8,344,836 | B2 | 1/2013 | Lauder et al. |
| 8,348,678 | B2 | 1/2013 | Hardisty et al. |
| 8,354,767 | B2 | 1/2013 | Pennander et al. |
| 8,390,411 | B2 | 3/2013 | Lauder et al. |
| 8,390,412 | B2 | 3/2013 | Lauder et al. |
| 8,390,413 | B2 | 3/2013 | Lauder et al. |
| 8,395,465 | B2 | 3/2013 | Lauder et al. |
| 8,398,409 | B2 | 3/2013 | Schmidt |
| 8,435,042 | B2 | 5/2013 | Rohrbach et al. |
| 8,454,372 | B2 | 6/2013 | Lee et al. |
| 8,467,829 | B2 | 6/2013 | Fadell et al. |
| 8,497,753 | B2 | 7/2013 | Difonzo et al. |
| 8,514,042 | B2 | 8/2013 | Lauder et al. |
| 8,535,088 | B2 | 9/2013 | Gao et al. |
| 8,576,031 | B2 | 11/2013 | Lauder et al. |
| 8,576,034 | B2 | 11/2013 | Bilbrey et al. |
| 8,616,362 | B1 | 12/2013 | Browne et al. |
| 8,648,679 | B2 | 2/2014 | Lauder et al. |
| 8,664,044 | B2 | 3/2014 | Jin et al. |
| 8,664,045 | B2 | 3/2014 | Tu et al. |
| 8,690,582 | B2 | 4/2014 | Rohrbach et al. |
| 8,702,316 | B2 | 4/2014 | DiFonzo et al. |
| 8,734,024 | B2 | 5/2014 | Isenhour et al. |
| 8,752,200 | B2 | 6/2014 | Varshavsky et al. |
| 8,757,893 | B1 | 6/2014 | Isenhour et al. |
| 8,770,857 | B2 | 7/2014 | DiFonzo et al. |
| 8,774,577 | B2 | 7/2014 | Benjamin et al. |
| 8,781,273 | B2 | 7/2014 | Benjamin et al. |
| 2002/0125977 | A1 | 9/2002 | VanZoest |
| 2003/0136837 | A1 | 7/2003 | Amon et al. |
| 2003/0170976 | A1 | 9/2003 | Molla et al. |
| 2003/0179880 | A1 | 9/2003 | Pan et al. |
| 2003/0187510 | A1 | 10/2003 | Hyde |
| 2004/0003487 | A1 | 1/2004 | Reiter |
| 2004/0155748 | A1 | 8/2004 | Steingroever |
| 2004/0244636 | A1 | 12/2004 | Meadow et al. |
| 2004/0251759 | A1 | 12/2004 | Hirzel |
| 2005/0102802 | A1 | 5/2005 | Sitbon et al. |
| 2005/0196484 | A1 | 9/2005 | Khoshnevis |
| 2005/0231046 | A1 | 10/2005 | Aoshima |
| 2005/0240263 | A1 | 10/2005 | Fogarty et al. |
| 2005/0263549 | A1 | 12/2005 | Scheiner |
| 2005/0283839 | A1 | 12/2005 | Cowburn |
| 2006/0066428 | A1 | 3/2006 | McCarthy et al. |
| 2006/0189259 | A1 | 8/2006 | Park et al. |
| 2006/0198047 | A1 | 9/2006 | Xue et al. |
| 2006/0198998 | A1 | 9/2006 | Raksha et al. |
| 2006/0214756 | A1 | 9/2006 | Elliott et al. |
| 2006/0290451 | A1 | 12/2006 | Prendergast et al. |
| 2006/0293762 | A1 | 12/2006 | Schulman et al. |
| 2007/0072476 | A1 | 3/2007 | Milan |
| 2007/0075594 | A1 | 4/2007 | Sadler |
| 2007/0103266 | A1 | 5/2007 | Wang et al. |
| 2007/0138806 | A1 | 6/2007 | Ligtenberg et al. |
| 2007/0255400 | A1 | 11/2007 | Parravicini et al. |
| 2007/0267929 | A1 | 11/2007 | Pulnikov et al. |
| 2008/0119250 | A1 | 5/2008 | Cho et al. |
| 2008/0139261 | A1 | 6/2008 | Cho et al. |
| 2008/0174392 | A1 | 7/2008 | Cho |
| 2008/0181804 | A1 | 7/2008 | Tanigawa et al. |
| 2008/0186683 | A1 | 8/2008 | Ligtenberg et al. |
| 2008/0218299 | A1 | 9/2008 | Arnold |
| 2008/0224806 | A1 | 9/2008 | Ogden et al. |
| 2008/0272868 | A1 | 11/2008 | Prendergast et al. |
| 2008/0282517 | A1 | 11/2008 | Claro |
| 2009/0021333 | A1 | 1/2009 | Fiedler |
| 2009/0209173 | A1 | 8/2009 | Arledge et al. |
| 2009/0250576 | A1 | 10/2009 | Fullerton et al. |
| 2009/0251256 | A1 | 10/2009 | Fullerton et al. |
| 2009/0254196 | A1 | 10/2009 | Cox et al. |
| 2009/0278642 | A1 | 11/2009 | Fullerton et al. |
| 2009/0289090 | A1 | 11/2009 | Fullerton et al. |
| 2009/0289749 | A1 | 11/2009 | Fullerton et al. |
| 2009/0292371 | A1 | 11/2009 | Fullerton et al. |
| 2010/0033280 | A1 | 2/2010 | Bird et al. |
| 2010/0126857 | A1 | 5/2010 | Polwart et al. |
| 2010/0167576 | A1 | 7/2010 | Zhou |
| 2011/0026203 | A1 | 2/2011 | Ligtenberg et al. |
| 2011/0085157 | A1 | 4/2011 | Bloss et al. |
| 2011/0101088 | A1 | 5/2011 | Marguerettaz et al. |
| 2011/0210636 | A1 | 9/2011 | Kuhlmann-Wilsdorf |
| 2011/0234344 | A1 | 9/2011 | Fullerton et al. |
| 2011/0248806 | A1 | 10/2011 | Michael |
| 2011/0279206 | A1 | 11/2011 | Fullerton et al. |
| 2012/0007704 | A1 | 1/2012 | Nerl |
| 2012/0064309 | A1 | 3/2012 | Kwon et al. |
| 2012/0085753 | A1 | 4/2012 | Fitch et al. |
| 2012/0235519 | A1 | 9/2012 | Dyer et al. |
| 2013/0186209 | A1 | 7/2013 | Herbst |
| 2013/0186473 | A1 | 7/2013 | Mankame et al. |
| 2013/0186807 | A1 | 7/2013 | Browne et al. |
| 2013/0187538 | A1 | 7/2013 | Herbst |
| 2013/0192860 | A1 | 8/2013 | Puzio et al. |
| 2013/0207758 | A1 | 8/2013 | Browne et al. |
| 2013/0252375 | A1 | 9/2013 | Yi et al. |
| 2013/0256274 | A1 | 10/2013 | Faulkner |
| 2013/0270056 | A1 | 10/2013 | Mankame et al. |
| 2013/0305705 | A1 | 11/2013 | Ac et al. |
| 2013/0341137 | A1 | 12/2013 | Mandame et al. |
| 2014/0001745 | A1 | 1/2014 | Lehmann et al. |
| 2014/0044972 | A1 | 2/2014 | Menassa et al. |
| 2014/0072261 | A1 | 3/2014 | Isenhour et al. |
| 2014/0152252 | A1 | 6/2014 | Wood et al. |
| 2014/0205235 | A1 | 7/2014 | Benjamin et al. |
| 2014/0221741 | A1 | 8/2014 | Wang et al. |

FOREIGN PATENT DOCUMENTS

| | | | |
|---|---|---|---|
| EP | 0 345 554 | A1 | 12/1989 |
| EP | 0 545 737 | A1 | 6/1993 |

(56) References Cited

FOREIGN PATENT DOCUMENTS

| | | | |
|---|---|---|---|
| FR | 823395 | A | 1/1938 |
| GB | 1 495 677 | A | 12/1977 |
| JP | 557-55908 | U | 4/1982 |
| JP | 557-189423 | U | 12/1982 |
| JP | 60-091011 | U | 6/1985 |
| JP | 60-221238 | A | 11/1985 |
| JP | 64-30444 | A | 2/1989 |
| JP | 2001-328483 | A | 11/2001 |
| JP | 2008035676 | A | 2/2008 |
| JP | 2008165974 | A | 7/2008 |
| JP | 05-038123 | B2 | 10/2012 |
| WO | WO-02/31945 | A2 | 4/2002 |
| WO | WO-2007/081830 | A2 | 7/2007 |
| WO | WO-2009/124030 | A1 | 10/2009 |
| WO | WO-2010/141324 | A1 | 12/2010 |

OTHER PUBLICATIONS

Atallah, K., Howe, D. 2001, "A Novel High-Performance Magnetic Gear", IEEE Transactions on Magnetics, vol. 37, No. 4, Jul. 2001, p. 2844-2846.

Bassani, R., 2007, "Dynamic Stability of Passive Magnetic Bearings", Nonlinear Dynamics, V. 50, p. 161-168.

BNS 33 Range, Magnetic safety sensors, Rectangular design, http://www.farnell.com/datasheets/36449.pdf, 3 pages, date unknown.

Boston Gear 221S-4, One-stage Helical Gearbox, http://www.bostongearcom/pdf/product_sections/200_series_helical.pdf, referenced Jun. 2010.

Charpentier et al., 2001, "Mechanical Behavior of Axially Magnetized Permanent-Magnet Gears", IEEE Transactions on Magnetics, vol. 37, No. 3, May 2001, p. 1110-17.

Chau et al., 2008, "Transient Analysis of Coaxial Magnetic Gears Using Finite Element Comodeling", Journal of Applied Physics, vol. 103.

Choi et al., 2010, "Optimization of Magnetization Directions in a 3-D Magnetic Structure", IEEE Transactions on Magnetics, vol. 46, No. 6, Jun. 2010, p. 1603-06.

Correlated Magnetics Research, 2009, Online Video, "Innovative Magnetics Research in Huntsville", http://www.youtube.com/watch?v=m4m81JjZCJo.

Correlated Magnetics Research, 2009, Online Video, "Non-Contact Attachment Utilizing Permanent Magnets", http://www.youtube.com/watch?v=3xUm25CNNgQ.

Correlated Magnetics Research, 2010, Company Website, http://www.correlatedmagnetics.com.

Furlani 1996, "Analysis and optimization of synchronous magnetic couplings", J. Appl. Phys., vol. 79, No. 8, p. 4692.

Furlani 2001, "Permanent Magnet and Electromechanical Devices", Academic Press, San Diego.

Furlani, E.P., 2000, "Analytical analysis of magnetically coupled multipole cylinders", J. Phys. D: Appl. Phys., vol. 33, No. 1, p. 28-33.

General Electric DP 2.7 Wind Turbine Gearbox, http://www.gedrivetrain.com/insideDP27.cfm, referenced Jun. 2010.

Ha et al., 2002, "Design and Characteristic Analysis of Non-Contact Magnet Gear for Conveyor by Using Permanent Magnet", Conf. Record of the 2002 IEEE Industry Applications Conference, p. 1922-27.

Huang et al., 2008, "Development of a Magnetic Planetary Gearbox", IEEE Transactions on Magnetics, vol. 44, No. 3, p. 403-12.

International Search Report and Written Opinion dated Jun. 1, 2009, directed to counterpart application no. PCT/US2009/002027. (10 pages).

International Search Report and Written Opinion of the International Searching Authority issued in Application No. PCT/US12/61938 dated Feb. 26, 2013.

International Search Report and Written Opinion of the International Searching Authority issued in Application No. PCT/US2013/028095 dated May 13, 2013.

International Search Report and Written Opinion of the International Searching Authority issued in Application No. PCT/US2013/047986 dated Nov. 21, 2013.

International Search Report and Written Opinion, dated Apr. 8, 2011 issued in related International Application No. PCT/US2010/049410.

International Search Report and Written Opinion, dated Aug. 18, 2010, issued in related International Application No. PCT/US2010/036443.

International Search Report and Written Opinion, dated Jul. 13, 2010, issued in related International Application No. PCT/US2010/021612.

International Search Report and Written Opinion, dated May 14, 2009, issued in related International Application No. PCT/US2009/038925.

Jian et al., "Comparison of Coaxial Magnetic Gears With Different Topologies", IEEE Transactions on Magnetics, vol. 45, No. 10, Oct. 2009, p. 4526-29.

Jian, L., Chau, K.T., 2010, "A Coaxial Magnetic Gear With Halbach Permanent-Magnet Arrays", IEEE Transactions on Energy Conversion, vol. 25, No. 2, Jun. 2010, p. 319-28.

Jørgensen et al., "The Cycloid Permanent Magnetic Gear", IEEE Transactions on Industry Applications, vol. 44, No. 6, Nov./Dec. 2008, p. 1659-65.

Jørgensen et al., 2005, "Two dimensional model of a permanent magnet spur gear", Conf. Record of the 2005 IEEE Industry Applications Conference, p. 261-5.

Kim, "A future cost trends of magnetizer systems in Korea", Industrial Electronics, Control, and Instrumentation, 1996, vol. 2, Aug. 5, 1996, pp. 991-996.

Krasil'nikov et al., 2008, "Calculation of the Shear Force of Highly Coercive Permanent Magnets in Magnetic Systems With Consideration of Affiliation to a Certain Group Based on Residual Induction", Chemical and Petroleum Engineering, vol. 44, Nos. 7-8, p. 362-65.

Krasil'nikov et al., 2009, "Torque Determination for a Cylindrical Magnetic Clutch", Russian Engineering Research, vol. 29, No. 6, pp. 544-47.

Liu et al., 2009, "Design and Analysis of Interior-magnet Outer-rotor Concentric Magnetic Gears", Journal of Applied Physics, vol. 105.

Lorimer, W., Hartman, A., 1997, "Magnetization Pattern for Increased Coupling in Magnetic Clutches", IEEE Transactions on Magnetics, vol. 33, No. 5, Sep. 1997.

Mezani, S., Atallah, K., Howe, D. , 2006, "A high-performance axial-field magnetic gear", Journal of Applied Physics vol. 99.

Mi, "Magnetreater/Charger Model 580" Magnetic Instruments Inc. Product specification, May 4, 2009, http://web.archive.org/web/20090504064511/http://www.maginst.com/specifications/580_magnetreater.htm, 2 pages.

Neugart PLE-160, One-Stage Planetary Gearbox, http://www.neugartusa.com/ple_160_gb.pdf, referenced Jun. 2010.

Series BNS, Compatible Series AES Safety Controllers, http://www.schmersalusa.com/safety_controllers/drawings/aes.pdf, pp. 159-175, date unknown.

Series BNS-B20, Coded-Magnet Sensorr Safety Door Handle, http://www.schmersalusa.com/catalog_pdfs/BNS_B20.pdf, 2pages, date unknown.

Series BNS333, Coded-Magnet Sensors with Integral Safety Control Module, http://www.schmersalusa.com/machine_guarding/coded_magnet/drawings/bns333.pdf, 2 pages, date unknown.

Tsurumoto 1992, "Basic Analysis on Transmitted Force of Magnetic Gear Using Permanent Magnet", IEEE Translation Journal on Magnetics in Japan, Vo 7, No. 6, Jun. 1992, p. 447-52.

United States Office Action issued in U.S. Appl. No. 13/104,393 dated Apr. 4, 2013.

United States Office Action issued in U.S. Appl. No. 13/236,413 dated Jun. 6, 2013.

United States Office Action issued in U.S. Appl. No. 13/246,584 dated May 16, 2013.

United States Office Action issued in U.S. Appl. No. 13/246,584 dated Oct. 15, 2013.

United States Office Action issued in U.S. Appl. No. 13/374,074 dated Feb. 21, 2013.

(56) References Cited

OTHER PUBLICATIONS

United States Office Action issued in U.S. Appl. No. 13/430,219 dated Aug. 13, 2013.
United States Office Action issued in U.S. Appl. No. 13/470,994 dated Aug. 8, 2013.
United States Office Action issued in U.S. Appl. No. 13/470,994 dated Jan. 7, 2013.
United States Office Action issued in U.S. Appl. No. 13/470,994 dated Nov. 8, 2013.
United States Office Action issued in U.S. Appl. No. 13/529,520 dated Sep. 28,2012.
United States Office Action issued in U.S. Appl. No. 13/530,893 dated Mar. 22, 2013.
United States Office Action issued in U.S. Appl. No. 13/530,893 dated Oct. 29, 2013.
United States Office Action issued in U.S. Appl. No. 13/718,839 dated Dec. 16, 2013.
United States Office Action issued in U.S. Appl. No. 13/855,519 dated Jul. 17, 2013.
United States Office Action issued in U.S. Appl. No. 13/928,126 dated Oct. 11, 2013.
United States Office Action, dated Aug. 26, 2011, issued in counterpart U.S. Appl. No. 12/206,270.
United States Office Action, dated Feb. 2, 2011, issued in counterpart U.S. Appl. No. 12/476,952.
United States Office Action, dated Mar. 12, 2012, issued in counterpart U.S. Appl. No. 12/206,270.
United States Office Action, dated Mar. 9, 2012, issued in counterpart U.S. Appl. No. 13/371,280.
United States Office Action, dated Oct. 12, 2011, issued in counterpart U.S. Appl. No. 12/476,952.
Wikipedia, "Barker Code", Web article, last modified Aug. 2, 2008, 2 pages.
Wikipedia, "Bitter Electromagnet", Web article, last modified Aug. 2011, 1 page.
Wikipedia, "Costas Array", Web article, last modified Oct. 7, 2008, 4 pages.
Wikipedia, "Gold Code", Web article, last modified Jul. 27, 2008, 1 page.
Wikipedia, "Golomb Ruler", Web article, last modified Nov. 4, 2008, 3 pages.
Wikipedia, "Kasami Code", Web article, last modified Jun. 11, 2008, 1 page.
Wikipedia, "Linear feedback shift register", Web article, last modified Nov. 11, 2008, 6 pages.
Wikipedia, "Walsh Code", Web article, last modified Sep. 17, 2008, 2 pages.
C. Pompermaier, L. Sjoberg, and G. Nord, Design and Optimization of a Permanent Magnet Transverse Flux Machine, XXth International Conference on Electrical Machines, Sep. 2012, p. 606, IEEE Catalog No. CFP1290B-PRT, ISBN: 978-1-673-0143-5.
V. Rudnev, an Objective Assessment of Magnetic Flux Concentrators, Het Trating Progress, Nov./Dec. 2004, p. 19-23.

MAGNETIC ATTACHMENT SYSTEM

RELATED APPLICATIONS

This application is a continuation in part of non-provisional application Ser. No. 14/035,818, titled: "Magnetic Structures and Methods for Defining Magnetic Structures Using One-Dimensional Codes" filed Sep. 24, 2013 by Fullerton et al. and claims the benefit under 35 USC 119(e) of provisional application 61/851,275, titled "Magnetic Attachment System", filed Mar. 6, 2013, by Roberts et al.; Ser. No. 14/035,818 is a continuation in part of non-provisional application Ser. No. 13/959,649, titled: "Magnetic Device Using Non Polarized Magnetic Attraction Elements" filed Aug. 5, 2013 by Richards et al. and claims the benefit under 35 USC 119(e) of provisional application 61/744,342, titled "Magnetic Structures and Methods for Defining Magnetic Structures Using One-Dimensional Codes", filed Sep. 24, 2012 by Roberts; Ser. No. 13/959,649 is a continuation in part of non-provisional Application Ser. No. 13/759,695, titled: "System and Method for Defining Magnetic Structures" filed Feb. 5, 2013 by Fullerton et al., which is a continuation of application Ser. No. 13/481,554, titled: "System and Method for Defining Magnetic Structures", filed May 25, 2012, by Fullerton et al., U.S. Pat. No. 8,368,495; which is a continuation-in-part of Non-provisional application Ser. No. 13/351,203, titled "A Key System For Enabling Operation Of A Device", filed Jan. 16, 2012, by Fullerton et al., U.S. Pat. No. 8,314,671; Ser. No. 13/481,554 also claims the benefit under 35 USC 119(e) of provisional application 61/519,664, titled "System and Method for Defining Magnetic Structures", filed May 25, 2011 by Roberts et al.; Ser. No. 13/351,203 is a continuation of application Ser. No. 13,157,975, titled "Magnetic Attachment System With Low Cross Correlation", filed Jun. 10, 2011, by Fullerton et al., U.S. Pat. No. 8,098,122, which is a continuation of application Ser. No. 12/952,391, titled: "Magnetic Attachment System", filed Nov. 23, 2010 by Fullerton et al., U.S. Pat. No. 7,961,069; which is a continuation of application Ser. No. 12/478,911, titled "Magnetically Attachable and Detachable Panel System" filed Jun. 5, 2009 by Fullerton et al., U.S. Pat. No. 7,843,295; Ser. No. 12/952,391 is also a continuation of application Ser. No. 12/478,950, titled "Magnetically Attachable and Detachable Panel Method," filed Jun. 5, 2009 by Fullerton et al., U.S. Pat. No. 7,843,296; Ser. No. 12/952,391 is also a continuation of application Ser. No. 12/478,969, titled "Coded Magnet Structures for Selective Association of Articles," filed Jun. 5, 2009 by Fullerton et al., U.S. Pat. No. 7,843,297; Ser. No. 12/952,391 is also a continuation of application Ser. No. 12/479,013, titled "Magnetic Force Profile System Using Coded Magnet Structures," filed Jun. 5, 2009 by Fullerton et al., U.S. Pat. No. 7,839,247; the preceding four applications above are each a continuation-in-part of Non-provisional application Ser. No. 12/476,952 filed Jun. 2, 2009, by Fullerton et al., titled "A Field Emission System and Method", which is a continuation-in-part of Non-provisional application Ser. No. 12/322,561, filed Feb. 4, 2009 by Fullerton et al., titled "System and Method for Producing an Electric Pulse", which is a continuation-in-part application of Non-provisional application Ser. No. 12/358,423, filed Jan. 23, 2009 by Fullerton et al., titled "A Field Emission System and Method", which is a continuation-in-part application of Non-provisional application Ser. No. 12/123,718, filed May 20, 2008 by Fullerton et al., titled "A Field Emission System and Method", U.S. Pat. No. 7,800,471, which claims the benefit under 35 USC 119(e) of U.S. Provisional Application Ser. No. 61/123,019, filed Apr. 4, 2008 by Fullerton, titled "A Field Emission System and Method". The applications and patents listed above are incorporated by reference herein in their entirety.

FIELD OF THE INVENTION

The present invention relates generally to a system for magnetic attachment. More particularly, the present invention relates to a system for magnetic attachment involving a male component and female component each having complementary magnetic structures.

SUMMARY OF THE INVENTION

A magnetic attachment system includes a female component associated with a first object, the female component including a hole and a first magnetic structure having a first plurality of magnetic source regions having a first polarity pattern, and a male component associated with a second object, the male component including a peg that can be inserted into the hole and a second magnetic structure having a second plurality of magnetic source regions having a second polarity pattern complementary to the first polarity pattern. The male component and the female component are configured such that when the peg is inserted into the hole the first and second magnetic structures face each other across an interface boundary enabling magnetic attachment of the first object to the second object, where while the peg remains within said hole said male component can be rotated relative to the female component but translational movement of the male component relative to the female component is constrained, where the first polarity pattern and said second polarity pattern are in accordance with a cyclic implementation of a code of length N, and where said code has a cyclic correlation function having a single peak and a plurality of off peaks per code modulo.

The first and second polarity patterns can be irregular polarity patterns.

The first and second magnetic structures can produce a peak attract force when in a complementary rotational alignment position that magnetically attaches the first object to the second object.

The first and second magnetic structures can produce an off-peak force that is an attract force less than the peak attract force when the male component has been rotated relative to the female component plus or minus 360/N degrees from the complementary rotational alignment position and said cyclic implementation of said code includes only one code modulo of said code.

The first and second magnetic structures can produce an off-peak force that is a substantially zero force when the male component has been rotated relative to the female component plus or minus 360/N degrees from the complementary rotational alignment position and said cyclic implementation of said code includes only one code modulo of said code.

The first and second magnetic structures can produce an off-peak force that is a repel force when the male component has been rotated relative to the female component plus or minus 360/N degrees from the complementary rotational alignment position and said cyclic implementation of said code includes only one code modulo of said code.

The code can be a Barker code.

Each symbol of the code can be implemented with one of a region having a first polarity or a region having a second polarity.

Each symbol of the code can be implemented with an irregular polarity pattern.

Each symbol of the code can be a Barker code.

Each symbol of the code can be implemented with alternating polarity regions, where one polarity region can be rotated relative to another polarity region and/or polarities of opposing regions of the first and second magnetic structures can be exchanged.

One of the first object or the second object can be one of a flashlight, a strap, an electronic device, a cell phone, a PDA, a camera, a GPS, a sign, a picture, a fire extinguisher, or a rod holder.

One of the first object or the second object can be one of a wall, a vehicle, or a garment.

At least one of the male component or the female component can include at least one of attachment holes enabling attachment to at least one of said first object or said second object using a nail or screw, an adhesive enabling attachment to at least one of said first object or said second object, rounded edges, first notches providing a hand grip, at least one marking for identifying one or more alignment positions, or at least one second notch for removing said at least one of said first magnetic structure or said second magnetic structure using a tool.

The male component can be integrated with the first object.

The female component can be integrated with the second object.

One of the male component or the female component can be placed inside a pocket of a garment.

One of the male component or the second component can be integrated into one of a sleeve, a shoulder portion of a garment, a belt, a hat, a knapsack, or a shoe.

BRIEF SUMMARY OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE INVENTION

Figure 1A:
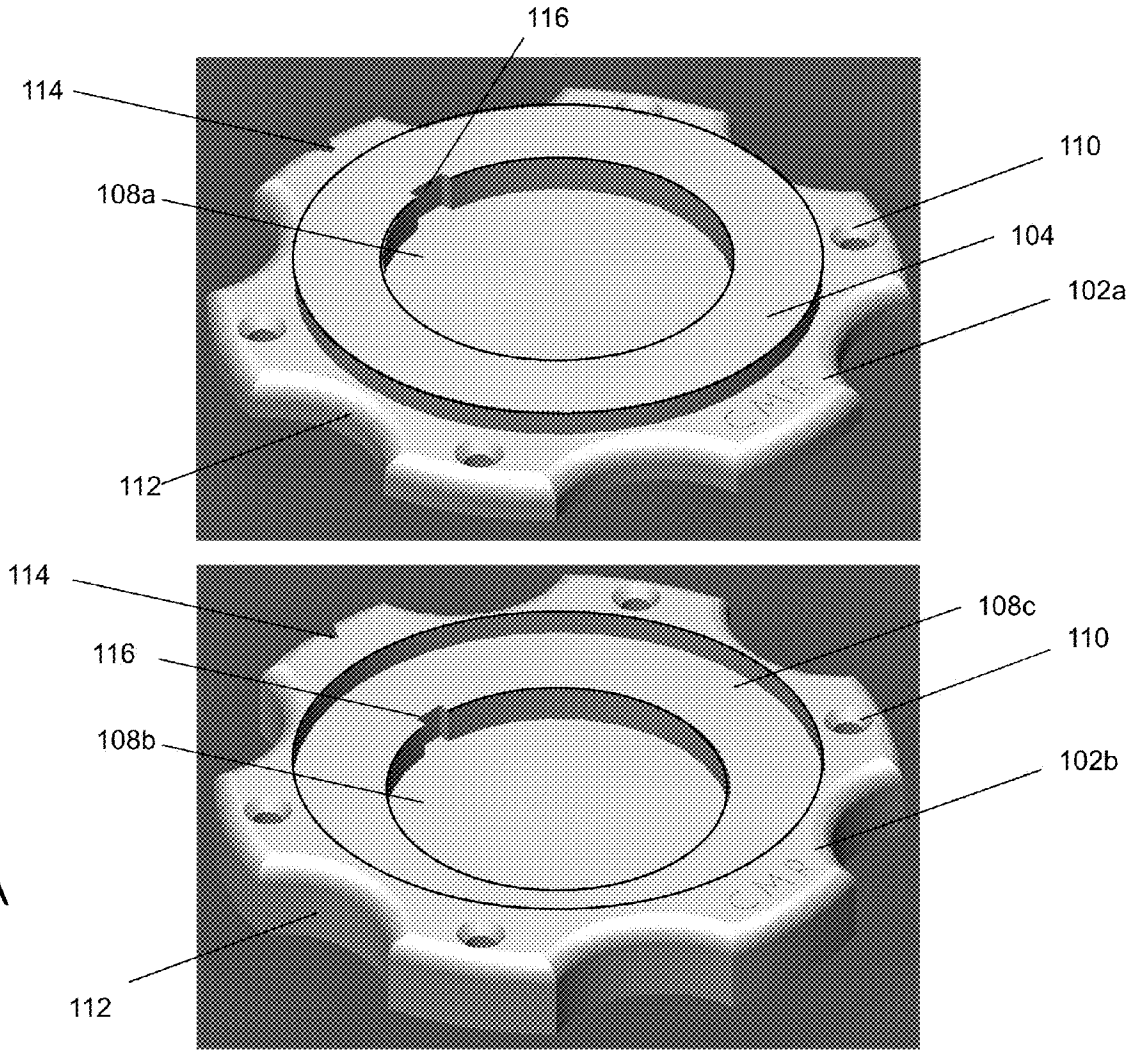
FIG. 1A depicts an exemplary male component and an exemplary female component in accordance with the invention.

The present invention will now be described more fully in detail with reference to the accompanying drawings, in which the preferred embodiments of the invention are shown. This invention should not, however, be construed as limited to the embodiments set forth herein; rather, they are provided so that this disclosure will be thorough and complete and will fully convey the scope of the invention to those skilled in the art.

Certain described embodiments may relate, by way of example but not limitation, to systems and/or apparatuses comprising magnetic structures, magnetic and non-magnetic materials, methods for using magnetic structures, magnetic structures produced via magnetic printing, magnetic structures comprising arrays of discrete magnetic elements, combinations thereof, and so forth. Example realizations for such embodiments may be facilitated, at least in part, by the use of an emerging, revolutionary technology that may be termed correlated magnetics. This revolutionary technology referred to herein as correlated magnetics was first fully described and enabled in the co-assigned U.S. Pat. No. 7,800,471 issued on Sep. 21, 2010, and entitled "A Field Emission System and Method". The contents of this document are hereby incorporated herein by reference. A second generation of a correlated magnetic technology is described and enabled in the co-assigned U.S. Pat. No. 7,868,721 issued on Jan. 11, 2011, and entitled "A Field Emission System and Method". The contents of this document are hereby incorporated herein by reference. A third generation of a correlated magnetic technology is described and enabled in the co-assigned U.S. Pat. No. 8,179,219, issued May 15, 2012, and entitled "A Field Emission System and Method". The contents of this document are hereby incorporated herein by reference. Another technology known as correlated inductance, which is related to correlated magnetics, has been described and enabled in the co-assigned U.S. Pat. No. 8,115,581 issued on Feb. 14, 2012, and entitled "A System and Method for Producing an Electric Pulse". The contents of this document are hereby incorporated by reference.

Material presented herein may relate to and/or be implemented in conjunction with multilevel correlated magnetic systems and methods for producing a multilevel correlated magnetic system such as described in U.S. Pat. No. 7,982,568 issued Jul. 19, 2011 which is all incorporated herein by reference in its entirety. Material presented herein may relate to and/or be implemented in conjunction with energy generation systems and methods such as described in U.S. patent application Ser. No. 13/184,543 filed Jul. 17, 2011, which is all incorporated herein by reference in its entirety. Such systems and methods described in U.S. Pat. No. 7,681,256 issued Mar. 23, 2010, U.S. Pat. No. 7,750,781 issued Jul. 6, 2010, U.S. Pat. No. 7,755,462 issued Jul. 13, 2010, U.S. Pat. No. 7,812,698 issued Oct. 12, 2010, U.S. Pat. Nos. 7,817,002, 7,817,003, 7,817,004, 7,817,005, and 7,817,006 issued Oct. 19, 2010, U.S. Pat. No. 7,821,367 issued Oct. 26, 2010, U.S. Pat. Nos. 7,823,300 and 7,824,083 issued Nov. 2, 2011, U.S. Pat. No. 7,834,729 issued Nov. 16, 2011, U.S. Pat. No. 7,839,247 issued Nov. 23, 2010, U.S. Pat. Nos. 7,843,295, 7,843,296, and 7,843,297 issued Nov. 30, 2010, U.S. Pat. No. 7,893,803 issued Feb. 22, 2011, U.S. Pat. Nos. 7,956,711 and 7,956,712 issued Jun. 7, 2011, U.S. Pat. Nos. 7,958,575, 7,961,068 and 7,961,069 issued Jun. 14, 2011, U.S. Pat. No. 7,963,818 issued Jun. 21, 2011, and U.S. Pat. Nos. 8,015,752 and 8,016,330 issued Sep. 13, 2011, and U.S. Pat. No. 8,035,260 issued Oct. 11, 2011 are all incorporated by reference herein in their entirety.

In accordance with one aspect of the invention, a magnetic attachment system comprises a male component and a female component, where the male component can be inserted into the female component. The male component comprises a first magnetic structure having a first plurality of magnetic source regions having a first polarity pattern. The female component comprises a second magnetic structure having a second plurality of magnetic source regions having a second polarity pattern complementary to said first polarity pattern. The male component and female component are configured such that a peg of the male component can be inserted into a hole within the female component such that the first and second magnetic structures face each other across an interface boundary. While the peg of the male component remains inserted within the hole within the female component the male component can be rotated relative to the female component but translational movement is constrained.

The first and second polarity patterns may be in accordance with a cyclic implementation of a code of length N having a cyclic correlation function having a single peak and a plurality of off peaks per code modulo. The first and second magnetic structures produce a peak attract force when in a complementary rotational alignment position. The first and second magnetic structures produce an off-peak force that is one of an attract force less than the peak attract force, a substantially zero force, or a repel force when the male component has been rotated relative to the female component plus or minus 360/N degrees from the complementary rotational alignment position. The first and second magnetic structure produce substantially the same off-peak force when the male component has been rotated relative to the female component between plus 360/N degrees from the complementary rotational alignment position and minus 360/N degrees from the complementary rotational alignment position.

Typically N is greater than 2, but N can be 2.

Under one arrangement, the first and second polarity patterns are irregular polarity patterns. Under such an arrangement, the code can be a Barker code having a length greater than 2.

Under another arrangement. Each symbol of the code can be implemented with a single polarity region, with alternating polarity regions where the alternating polarity regions can be arc segments that form concentric circles, or with an irregular polarity pattern such as a Barker code. The arc segments can also be subdivided into smaller arc segments having a polarities within a given symbol portion that is part of a given concentric circle. One concentric circle can be rotated relative to another concentric circle and the polarities of opposing concentric circles of the two magnetic structures can be exchanged.

FIG. 1A depicts a first exemplary first component 102*a* and a first exemplary second component 102*b*, which could be made of plastic or any other desired material. The first component 102*a* has a peg 104 having a round outer perimeter and has a first circular hole 108*a* for accepting a first circular magnetic structure (not shown). The second component 102*b* has a second circular hole 108*b* for accepting a second circular magnetic structure (not shown) and a third circular hole 108*c* having a round outer perimeter for accepting the peg 104 of the first component 102*a*.

The first component 102*a* and/or the second component 102*b* may include optional holes 110, for example countersunk holes, enabling attachment to objects (e.g., a wall) using screws, nails, etc. Alternatively or additionally, either or both of the first component 102*a* and second component 102*b* may have an adhesive on their back side (i.e., the sides beneath them are not shown). Such an adhesive may have a protective layer that can be removed to expose the adhesive at the time of installation. Furthermore, the first component 102*a* or the second component 102*b* could be integrated into an object. For example, the second circular hole 108*b* and third circular hole 108*c* could be formed in wood object such a wood door. Similarly, peg 104 could be attached directly to a wall using an adhesive.

The first component 102*a* and/or the second component 102*b* can have notches 112 providing for a better hand grip. Edges of the first component 102*a* and/or the second component 102*b* can also be rounded (e.g., to prevent harm to fingers). Other optional features include at least one notch 114 or other marking used for identifying one or more alignment positions or notches 116 for removing/replacing magnetic structures (e.g., with a flat head screwdriver). One skilled in the art will understand that the first and second magnetic structures can be placed into the first and second components in such a way that their peak attach force rotational alignment position corresponds to the alignment of notches 116 or other markings. For example, the magnetic structures can be attached in their peak attach force rotational alignment position and then placed into the first and second components.

Figure 1B:
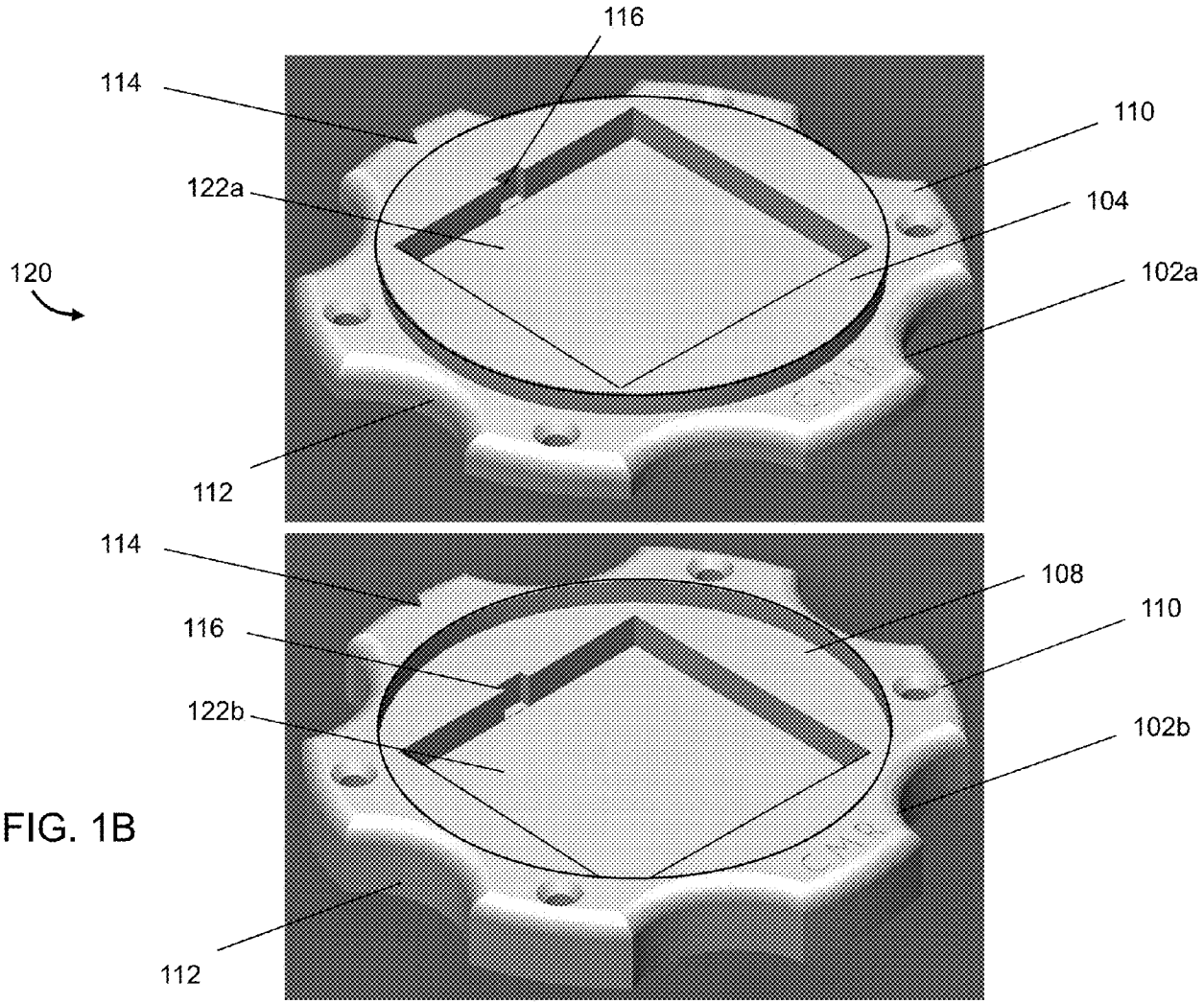
FIG. 1B depicts another exemplary male component and another exemplary female component in accordance with the invention.

FIG. 1B depicts a second exemplary first component 102*a* that has a first square hole 122*a* for receiving a first square magnetic structure (not shown) and a second exemplary second component 102*b* that has a second square hole 122*b* for receiving a second square magnetic structure (not shown) and a circular hole 108 for receiving the peg 104 of the first component 102*a*. One skilled the art will recognize that all sorts of different shapes of magnetic material can be used in accordance with the invention. Moreover, the outer perimeter of magnetic sources present on non-circular magnetic material can be circular, conform to the shape of the non-circular magnetic material, or have some other shape.

Figure 2A:
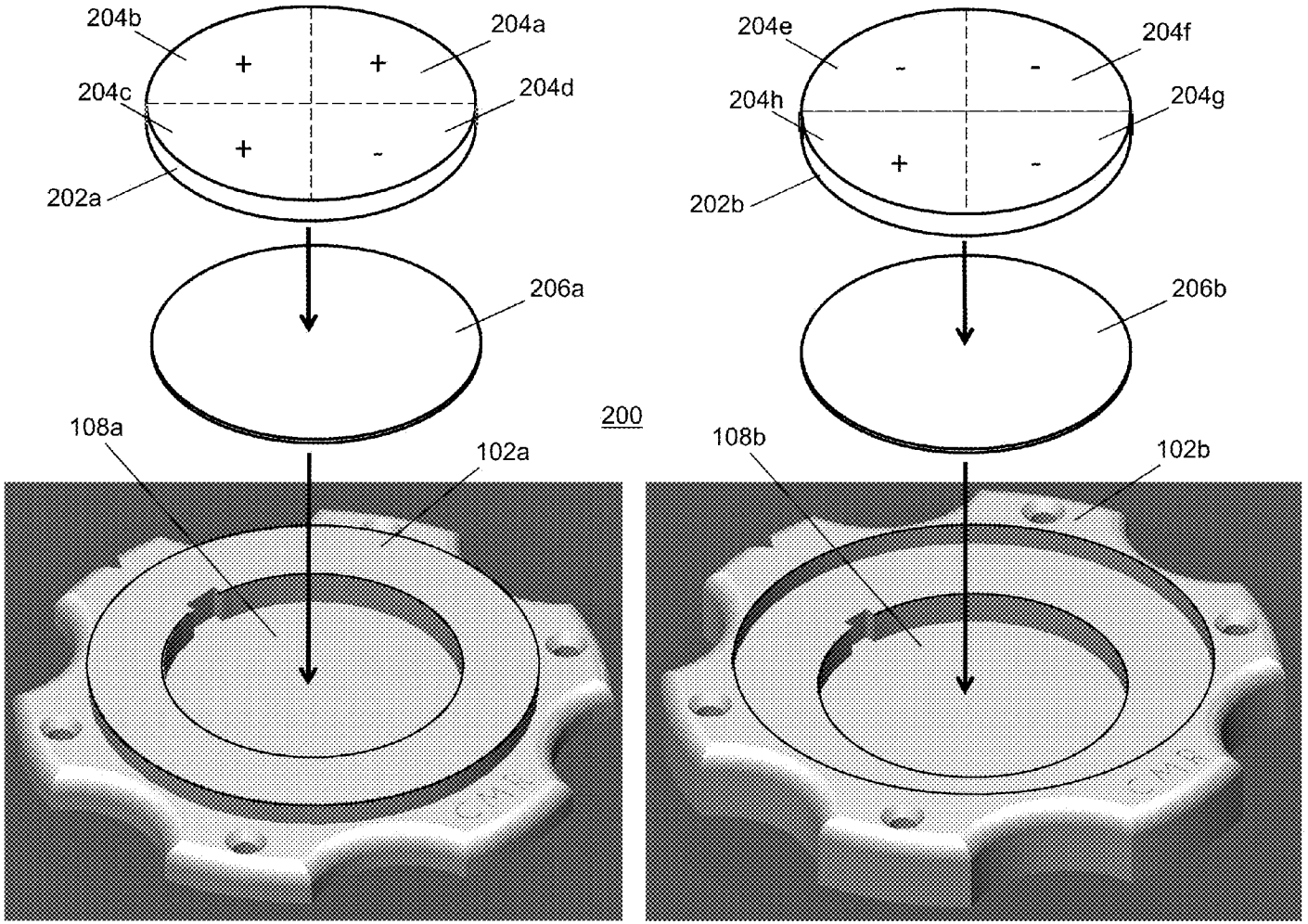
FIG. 2A depicts an exemplary method of assembly of an exemplary magnetic attachment system in accordance with the invention.

FIG. 2A depicts an exemplary method of assembly of an exemplary magnetic attachment system 200 in accordance with the invention. Referring to FIG. 2A, a first magnetic structure 202*a* comprising four quadrants 204*a*-204*d* has been magnetized such that the four quadrants 204*a*-204*d* have a first polarity pattern in accordance with a length 4 Barker code (or Barker 4 code). A second magnetic structure 202*b* having four quadrants 204*e*-204*g* has been magnetized such that the four quadrants 204*e*-204*g* have a second polarity pattern that is complementary to the first polarity pattern. Alternatively, multiple magnets can be used to produce either or both of the two magnetic structures in accordance with a Barker 4 code. For example, four quarter moon shaped magnets could be used or a three quarter moon shaped magnet could be used with a quarter moon shaped magnet.

Also shown in FIG. 2A are optional first and second shunt plates 206*a* 206*b*, where typically the first shunt plate 206*a* would be placed into the first circular hole 108*a* and the second shunt plate 206*b* would be placed into the second circular hole 108*b*. The first magnetic structure 202*a* can be placed into the first circular hole 108*a* on top of the first shunt plate 206*a* and the second magnetic structure 202*a* can be placed into the second circular hole 108*b* on top of the second shunt plate 206*b*. Shunt plates are disclosed in pending U.S. patent application Ser. No. 13/374,074, filed Dec. 9, 2011, titled "A System and Method for Affecting Flux of Magnetic Structures", which is incorporated by reference herein in its entirety.

Optionally, an adhesive can be placed beneath the shunt plates 206*a* 206*b* and/or beneath the magnetic structures so as to affix them in the first and second components. Alternatively or additionally, a covering layer (e.g., of plastic, Titanium, stainless steel, Aluminum, Brass, epoxy, etc.) can be placed on top of the magnetic structures to hold the magnetic structures in place within the first and second components. Alternatively or additionally a low-friction material (e.g., Teflon, Kapton) can be used to cover one or both of the magnetic structures (or a covering layer on top of one or both of the structures) or a high-friction material (e.g., neoprene or latex) could be used to cover one or both of the magnetic structures (or a covering layer on top of one or both of the structures) or a combination thereof. In one preferred embodiment a high-friction material can be used on one of the magnetic structures and a low-friction material can be used on the other. For example, in an application where a first component is placed inside a pocket of a garment and a second component is used to magnetically attach an object, for example, a camera to the garment the first component might have a low-friction material applied making it easy to turn the first component to detach the two structures while the second component would have a high-friction material making it more difficult for the object to turn by itself, for example, as a result of movement by the person wearing the garment. Alternatively, low and high-friction materials could be integrated in the first and second components at locations other than where the magnets are placed.

An alternative method of assembly of a magnetic attachment system in accordance with the present invention is disclosed in U.S. patent Ser. No. 13/779,611 filed Feb. 27, 2013, titled "System for detaching a magnetic structure from a ferromagnetic material", which is incorporated by reference. With this assembly method, a beveled magnetic structure is placed into a fixture (e.g., the first component or second component) via a hole in the back of the fixture such that a portion of the magnetic structure is exposed via a hole in the front of the fixture, for example a beveled hole, that is smaller than the magnetic structure, where the beveled portion of the magnet and fixture is used to hold the magnetic structure in place. With this approach, the fixture (i.e., first or second component) can be sealed in the back or not, an adhesive can be used or not, etc. but generally the hole in the front of the fixture being smaller than the magnet holds the magnetic structure in place.

All sorts of other well know methods of keeping magnetic structures in place are possible including set screws and the like.

Figure 2B:
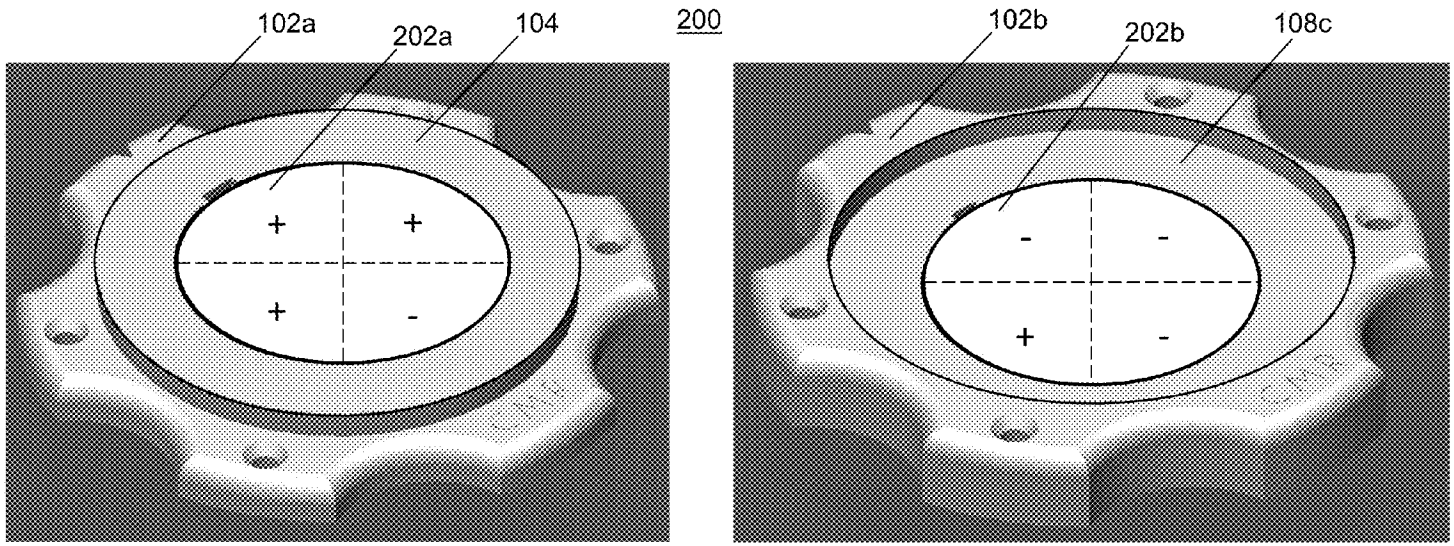
FIG. 2B depicts the exemplary magnetic attachment system of FIG. 2A after assembly.

FIG. 2B depicts an exemplary magnetic attachment system 200 after assembly. Either the first component 102*a* or the second component 102*b* as depicted can be turned over and placed onto the other component such that the peg 104 of the first component 102*a* becomes inserted into the third circular hole 208*c* of the second component 102*b* and the two magnetic structures 202*a* 202*b* magnetically engage. Once the peg has been inserted into the third circular hole 208*c*, the first component 102*a* can be rotated relative to the second component 102*b* to vary the rotational alignment of the first magnetic structure. As such, the first and second component 102*a* 102*b* prevent translational movement of the first magnetic structure 202*a* relative to the second magnetic structure 202*b*. As such, the two magnetic structures produce magnetic forces in accordance with their relative rotational alignment, which corresponds to the cyclic correlation function shown in FIG. 2C.

Figure 2C:
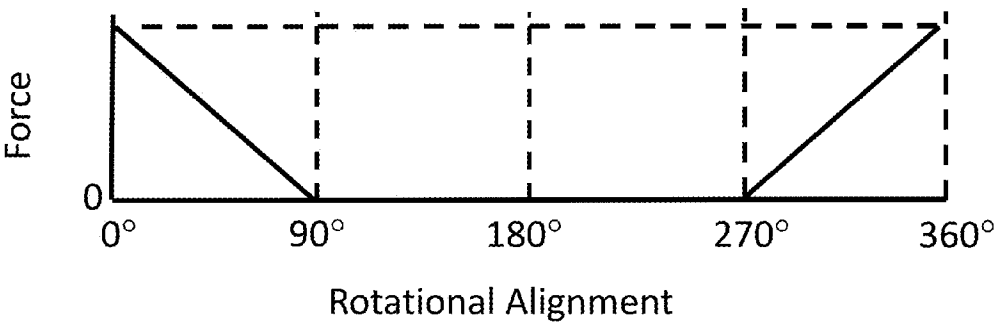
FIG. 2C depicts an exemplary cyclic correlation function of the two magnetic structures depicted in FIGS. 2A and 2B having polarity patterns in accordance with a Barker 4 code.

As seen in FIG. 2C, there is a peak attract force that is produced at a peak attract force rotational alignment position, which can be denoted 0°/360°. When one magnetic structure is rotated to a rotational alignment position that is +/−360°/4 (i.e., +/−90°) from the peak attract force rotational alignment position, the produced force becomes substantially cancelled (i.e., a zero force) and remains substantially cancelled for rotational alignments between +360°/4 (i.e., 90°) and −360°/4 (i.e., 270°) as depicted in FIG. 2C. Generally, for Barker codes of a given length N>2, the force produced between two complementary magnetic structures in a cyclic implementation will vary from a peak attract force produced at a peak attract force rotational alignment position to either a substantially zero force (N=4), an attract force less than the peak attract force (N=5 or 13), or a repel force (N=3, 7, or 11) when the relative alignment of the two structures is rotated +/−360°/N from the peak attract force rotational alignment position and the force will remain substantially constant between +360°/N and −360°/N.

It should also be noted that if the two magnetic structures are in an anti-complementary arrangement (i.e., one of the two structures shown in FIG. 2B is inverted), there is a peak repel force produced at a peak repel force rotational alignment position, which can be denoted 0°/360°. When one magnetic structure is rotated to a rotational alignment position that is +/−360°/4 (i.e., +/−90°) from the peak repel force rotational alignment position, the produced force becomes substantially cancelled (i.e., a zero force) and remains substantially cancelled for rotational alignments between +360°/4 (i.e., 90°) and −360°/4 (i.e., 270°) as depicted in FIG. 2C. Generally, for Barker codes of a given length N>2, the force produced between two anti-complementary magnetic structures in a cyclic implementation will produce forces that vary from a peak repel force produced at a peak repel force rotational alignment position to either a substantially zero force (N=4), a repel force less than the peak repel force (N=5 or 13), or an attract force (N=3, 7, or 11) when the relative alignment of the two structures is rotated +/−360°/N from the peak attract force rotational alignment position and the force will remain substantially constant between +360°/N and −360°/N.

Figure 2D:
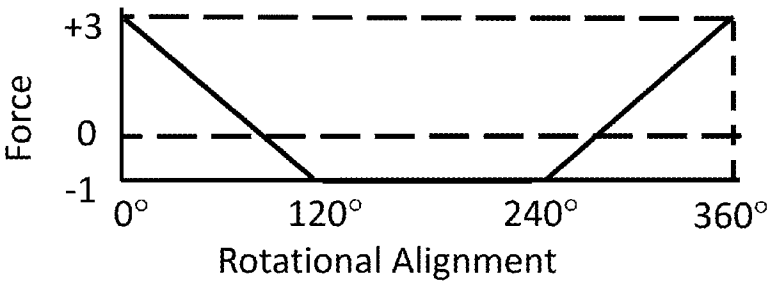
FIG. 2D depicts an exemplary cyclic correlation function of two magnetic structures having polarity patterns in accordance with a Barker 3 code.

FIG. 2D depicts the cyclic correlation function of complementary magnetic structures having polarity patterns in accordance with a Barker 3 code.

Figure 2E:
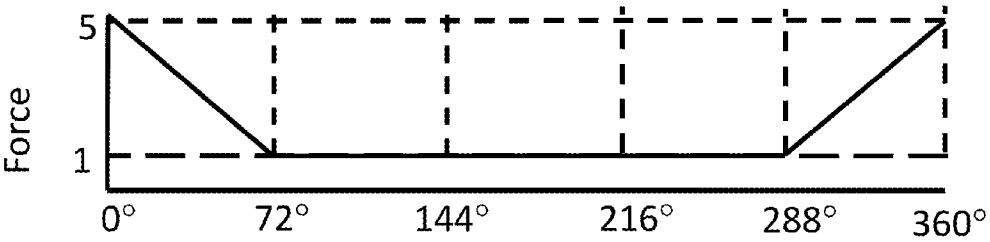
FIG. 2E depicts an exemplary cyclic correlation function of two magnetic structures having polarity patterns in accordance with a Barker 5 code.

FIG. 2E depicts the cyclic correlation function of complementary magnetic structures having polarity patterns in accordance with a Barker 5 code.

Figure 2F:
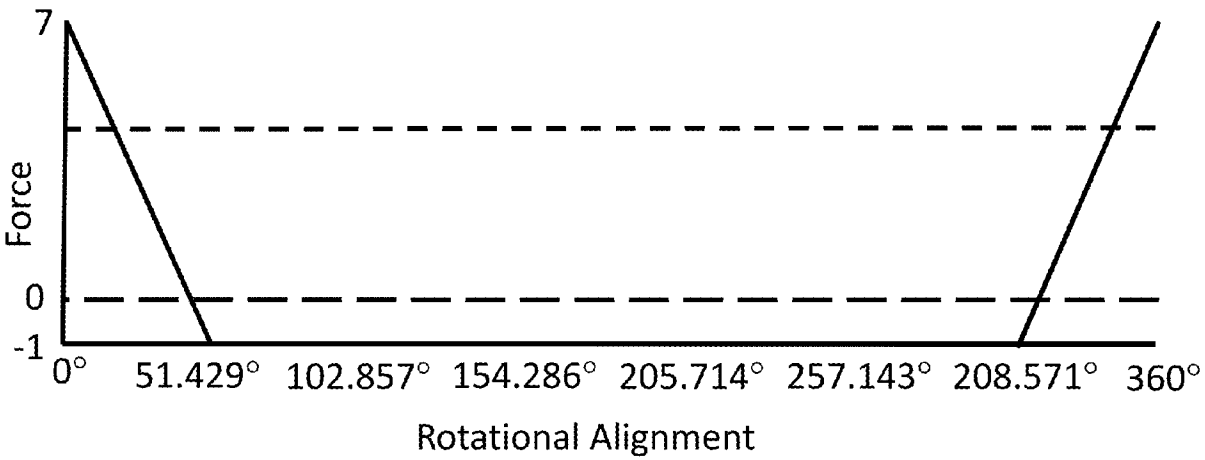
FIG. 2F depicts an exemplary cyclic correlation function of two magnetic structures having polarity patterns in accordance with a Barker 7 code.

FIG. 2F depicts the cyclic correlation function of complementary magnetic structures having polarity patterns in accordance with a Barker 7 code.

Figure 2G:
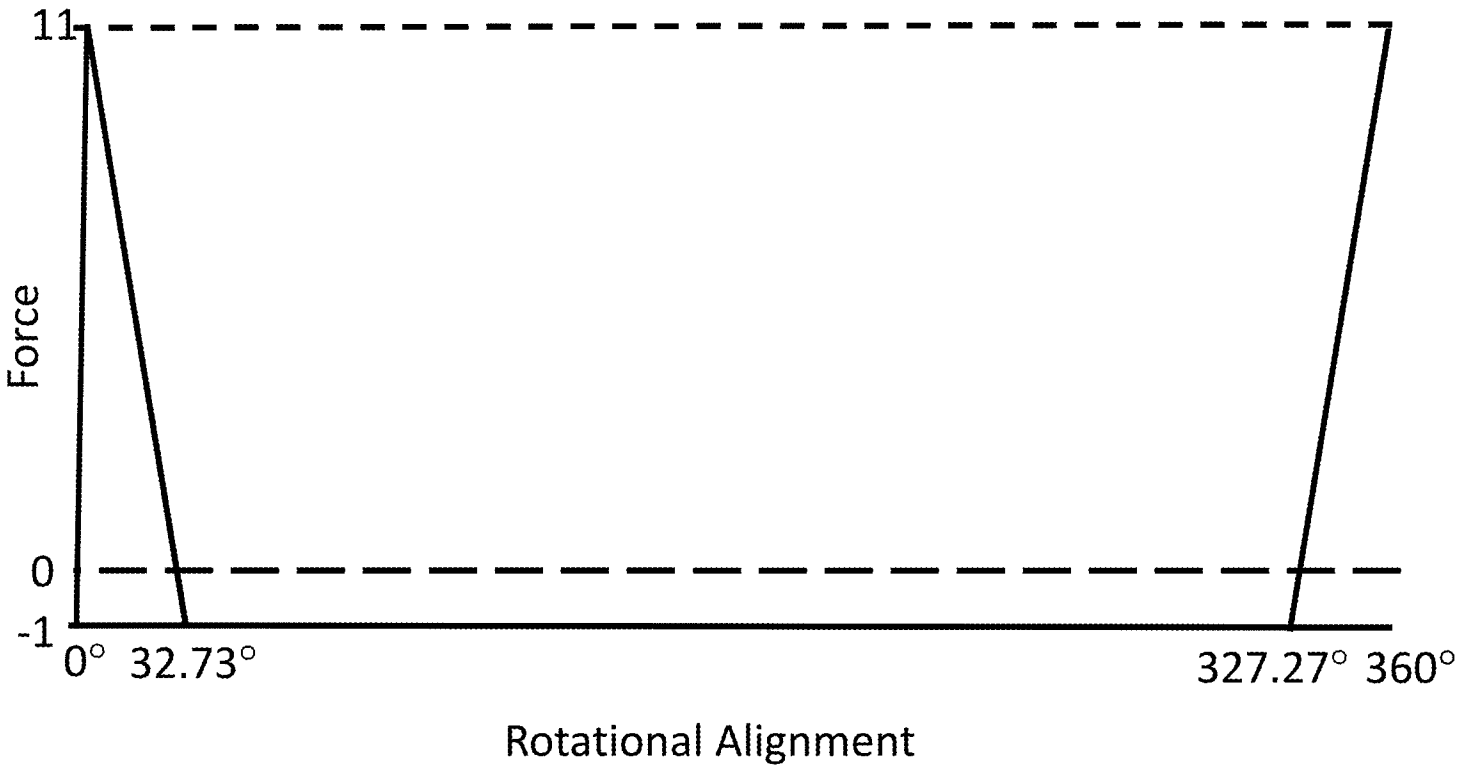
FIG. 2G depicts an exemplary cyclic correlation function of two magnetic structures having polarity patterns in accordance with a Barker 11 code.

FIG. 2G depicts the cyclic correlation function of complementary magnetic structures having polarity patterns in accordance with a Barker 11 code.

Figure 2H:
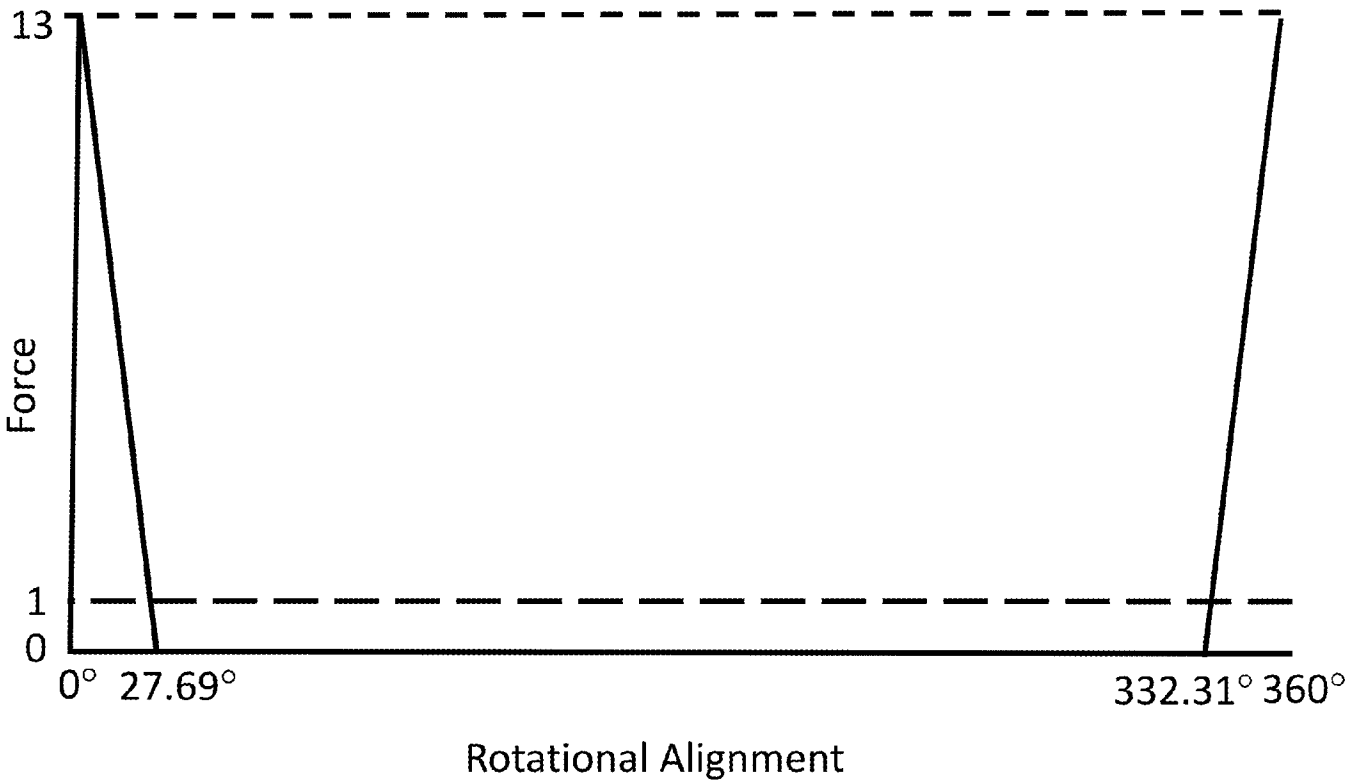
FIG. 2H depicts an exemplary cyclic correlation function of two magnetic structures having polarity patterns in accordance with a Barker 13 code.

FIG. 2H depicts the cyclic correlation function of complementary magnetic structures having polarity patterns in accordance with a Barker 13 code.

Although examples provided herein are all based on a Barker 4 code, any of the other Barker codes can be used in accordance with the present invention. Moreover pseudorandom codes can be used as well as other such codes, as has been previously disclosed.

Figure 3:
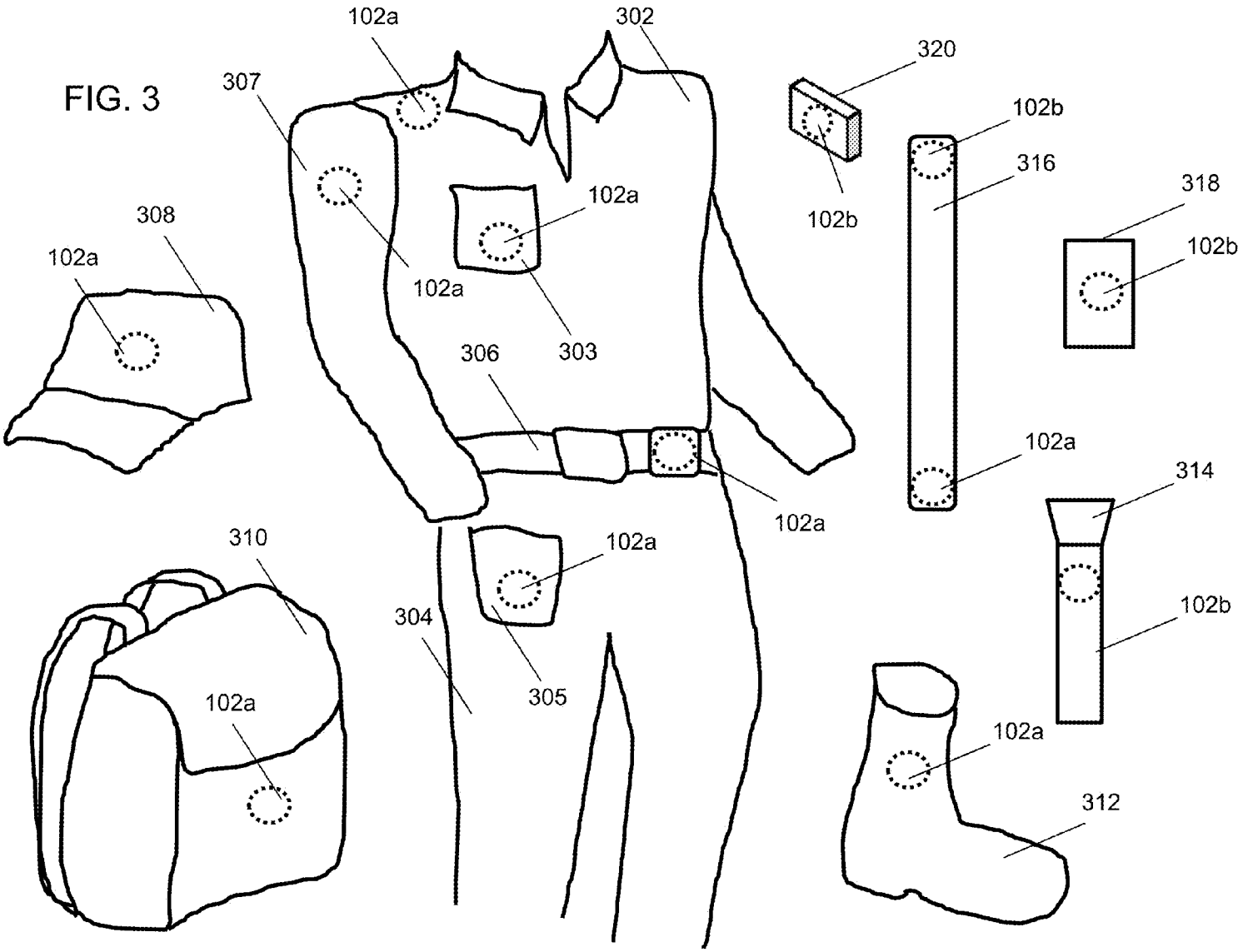
FIG. 3 depicts exemplary locations where an exemplary magnetic attachment system can be used in accordance with the invention.

FIG. 3 depicts exemplary locations were a magnetic attachment system can be used. As shown, a first component 102*a* can be placed inside a garment such as in the pocket 303 of a shirt 302 or pocket 305 of a pair of pants 304. As such, the garment material will be between the first and second magnetic structures. First components 102 can be integrated into a sleeve 307 or in a shoulder portion of the garment or perhaps integrated with a belt 306. Similarly, first components can be integrated into a hat 308, a knapsack 310, or a shoe 312. Such first components enable various types of objects having integrated second components 102*b* to be attached such as a flashlight 314, strap 316, electronic device 318 (e.g., a cell phone, PDA, etc.), or a camera 320. One skilled in the art will recognize that the first and second components are generally interchangeable from what is depicted in FIG. 3 (i.e., a second component can be used in place of the first component and vice versa).

Figure 4A:
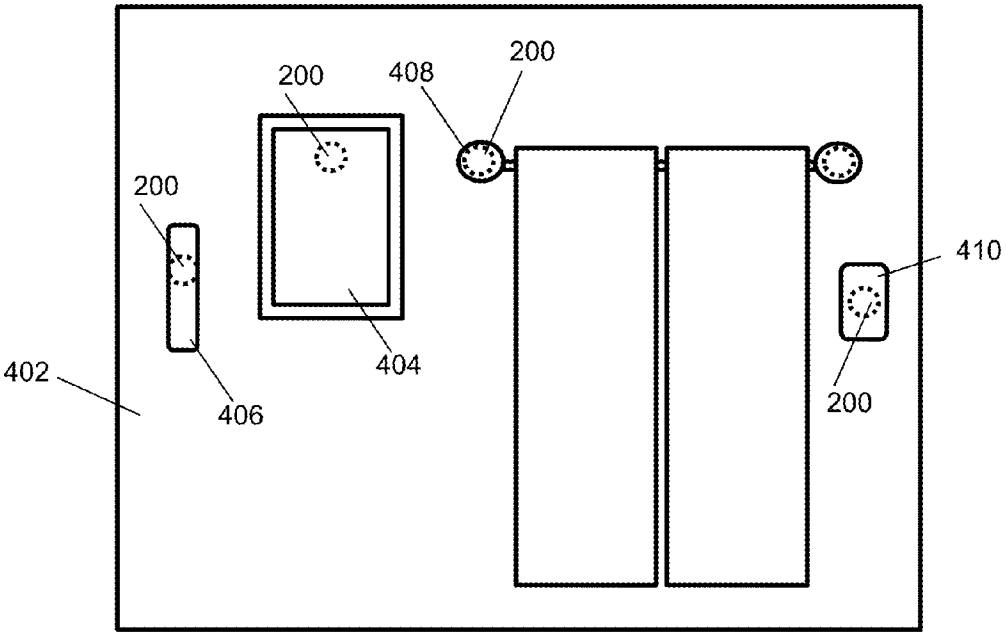
FIG. 4A depicts exemplary use of the magnetic attachment system for applications involving a wall.
Figure 4B:
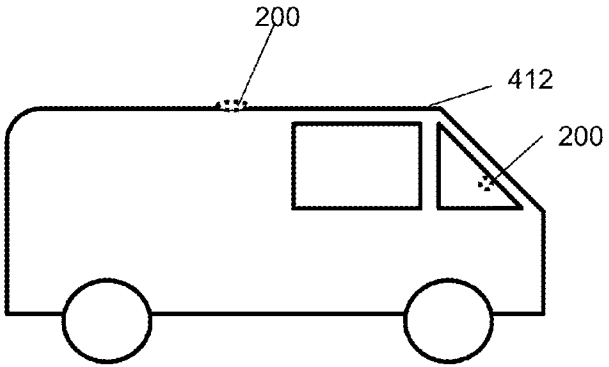
FIG. 4B depicts exemplary use of the magnetic attachment system for application involving a vehicle.

FIG. 4A depicts exemplary use of the magnetic attachment system 200 for applications involving a wall 402, where various types of objects that might need to be attached to a wall where it might be desirable to remove them. Examples of such objects include a picture 404, a fire extinguisher 406, a curtain rod holder 408, and an electronic device 410. FIG. 4B depicts an exemplary motorized vehicle 412 where a magnetic attachment system 200 might be used on top of the vehicle (e.g., for attaching a sign) or some other external surface of the vehicle or the system 200 might be used to attach an object (e.g., a PDA, GPS) to a dashboard or other internal surface of a vehicle. A vehicle may be a car, a truck, an emergency vehicle, a train, a boat, a plane, a RV, a motorcycle, etc. Generally, the magnetic attachment system of the present invention can be used to attach two objects.

Figure 5A:
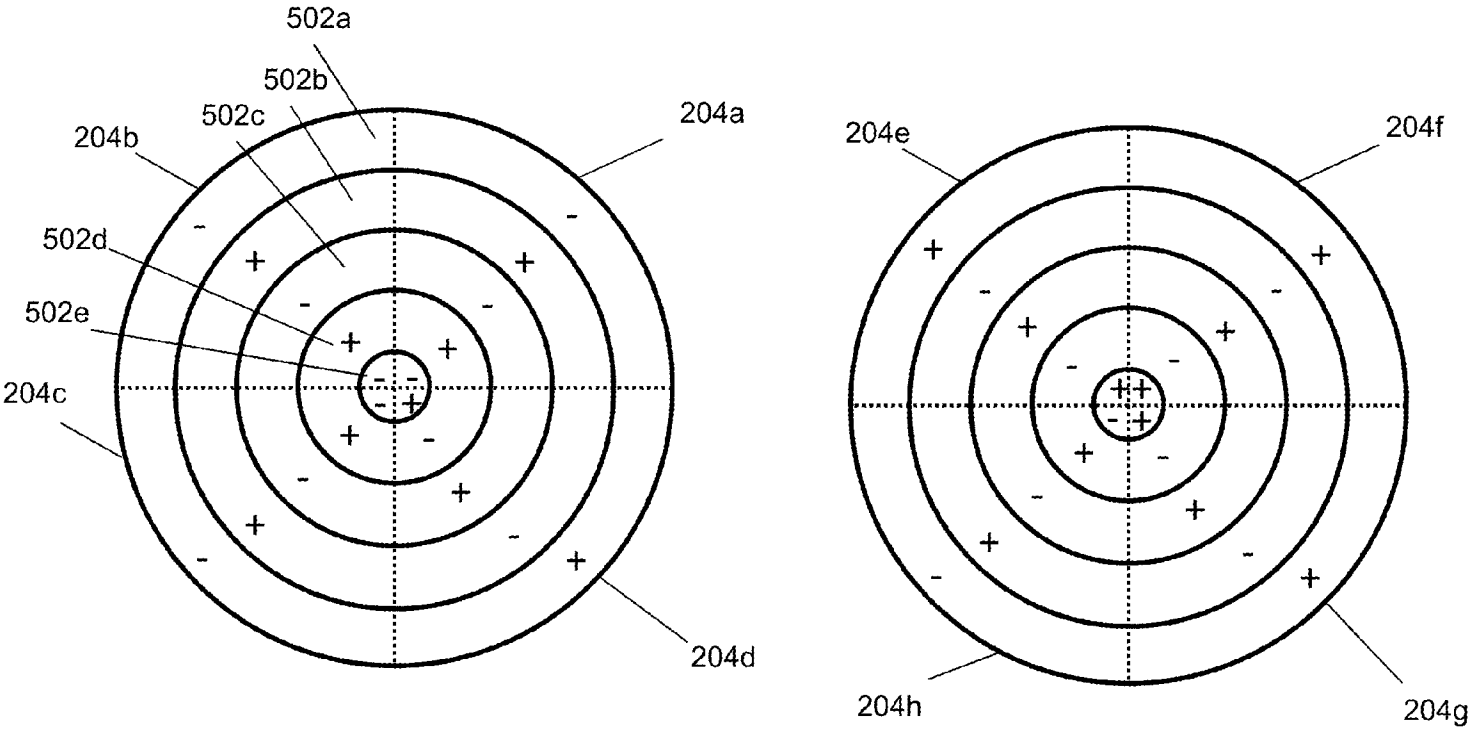
FIG. 5A depicts exemplary complementary Barker 4 coded magnetic structures having symbols corresponding to alternating polarity arc segments that form concentric circles.

FIG. 5A depicts complementary Barker 4 coded magnetic structures where each 'symbol' of the Barker 4 code corresponds to alternating polarity arc segments that together form five concentric Barker 4 coded circles 502*a*-502*e*. One skilled in the art will recognize that increasing or decreasing the number of concentric circles controls the amount of tensile forces produced and the throw of the two magnetic structures, which also the magnetic structures be tailored to achieve appropriate forces given the thickness of a material (e.g., clothing) to be placed between them.

Figure 5B:
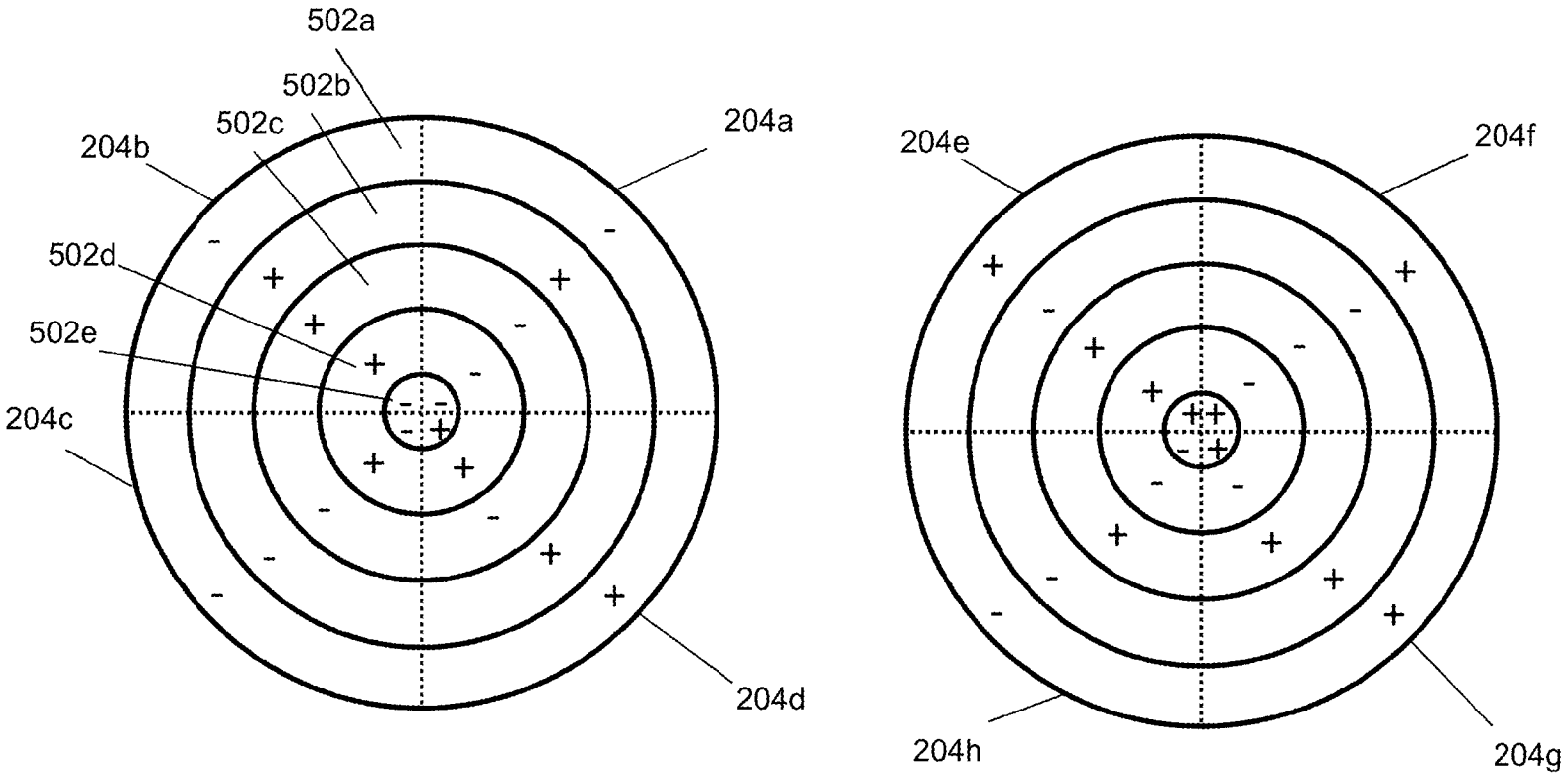
FIG. 5B depicts exemplary magnetic structure polarity pattern designs where the starting point of the Barker 4 code sequence is rotated 90° with each successive concentric circle.

FIG. 5B depicts exemplary magnetic structure polarity pattern designs where the starting point of the Barker 4 code sequence is rotated 90° with each successive concentric circle 502*a*-502*e*. By rotating the starting points of the circles, the locations where attract forces are occurring vs. where repel forces are occurring can be distributed, where it should be understood that prior to such rotation that between 90° and 270° half of the two magnetic structures would be in a repel state and the other half would be in an attract state. By rotating where the Barker codes start the net magnetic behavior stays the same but the locations of attract and repel forces can be distributed differently, where the number of possible combinations depends on the code length (e.g., 4) and the number of concentric circles used.

Figure 5C:
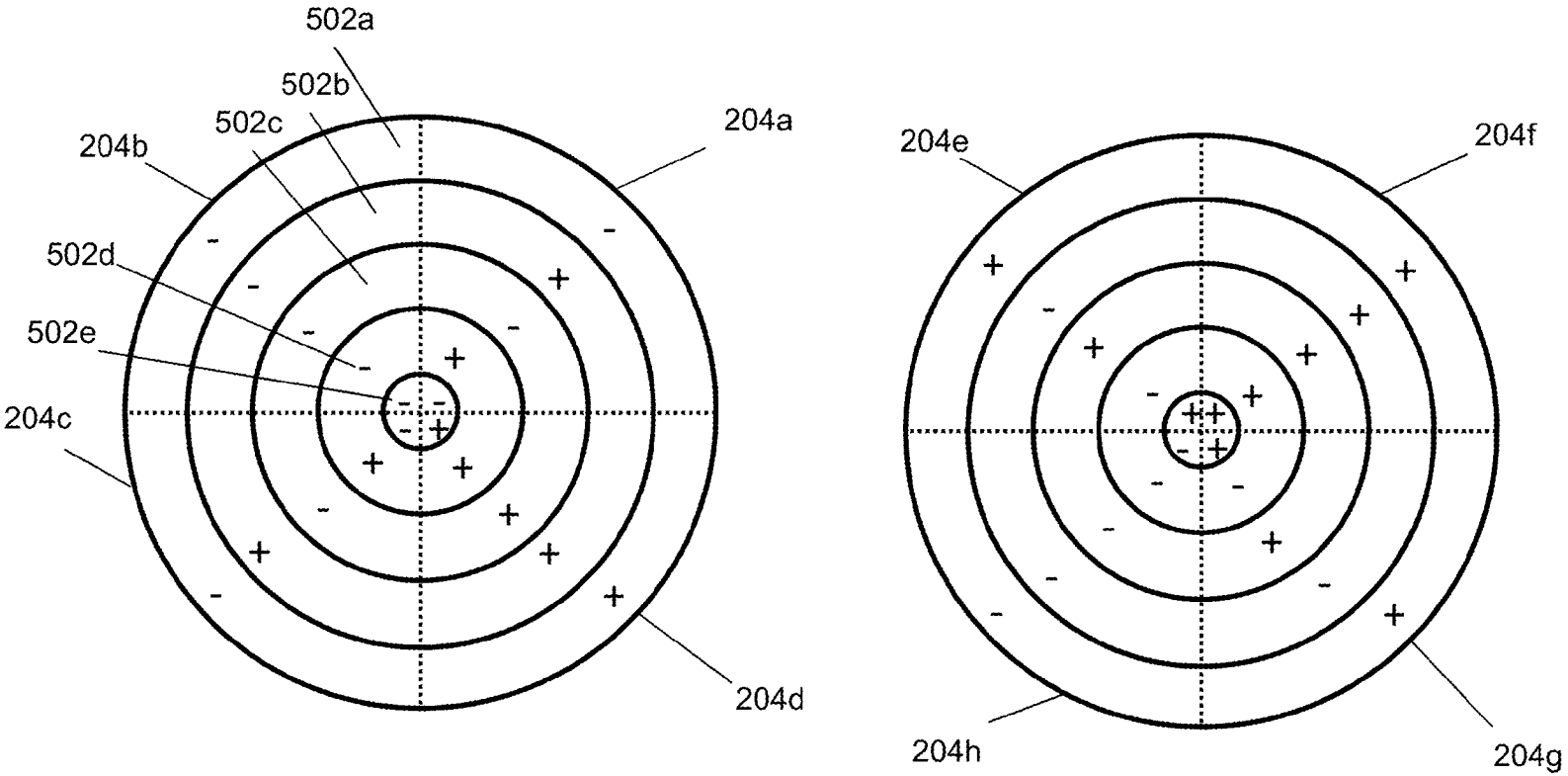
FIG. 5C depicts exemplary magnetic structure polarity pattern designs where the starting point for each Barker 4 pattern is shifted 180 degrees for each odd concentric circle.

FIG. 5C shifts the starting point for each Barker 4 pattern 180 degrees for each odd concentric circle. This design results in two opposing quadrants of opposite polarity and two opposing quadrants having the same alternating polarity pattern.

Figure 5D:
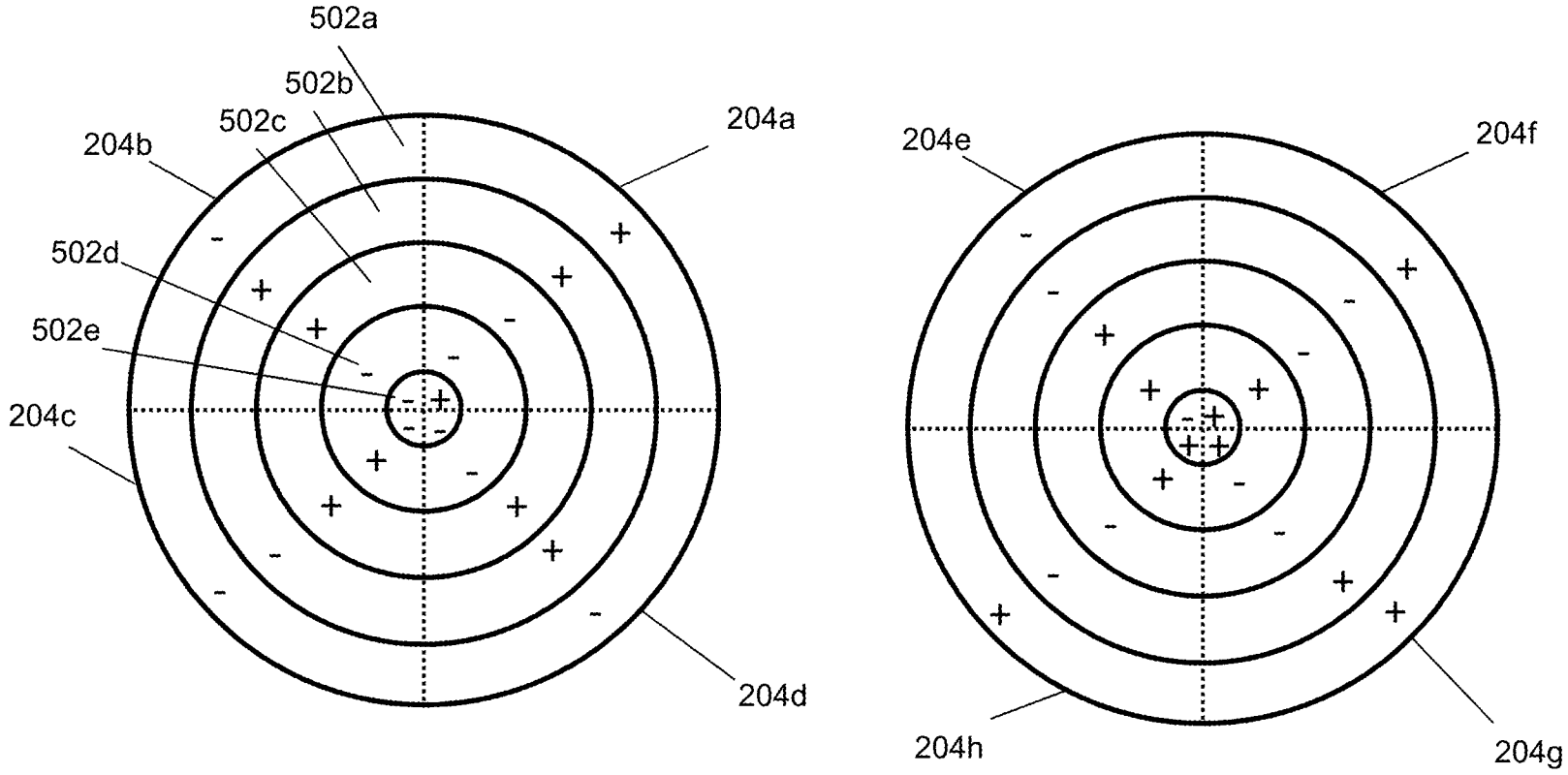
FIG. 5D depicts exemplary magnetic structure polarity pattern designs where the odd polarity quadrant shifts with each circle and the polarity of the third and fourth circles is reversed.

FIG. 5D shifts the odd polarity quadrant 180 with each circle and reverses the polarity of the third and fourth circles.

Figure 5E:
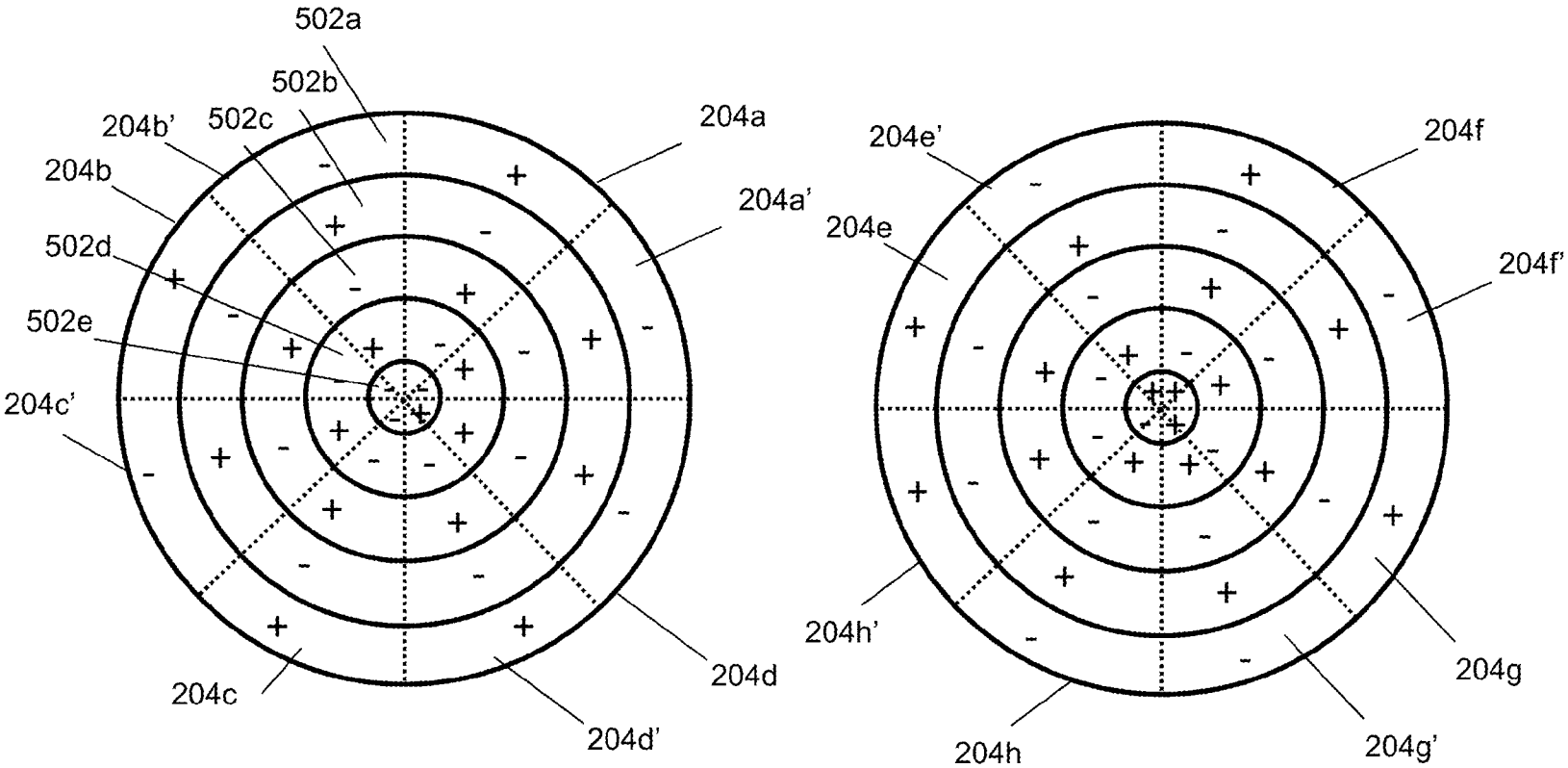
FIG. 5E depicts how the arc segments of each quadrant of FIG. 5D can be subdivided into alternating polarity portions.

FIG. 5E illustrates how the arc segments of each quadrant can be subdivided into alternating polarity portions where increasing the number of portions per arc segments increases the tensile force, decreases the throw, and increases the rotational shear force (or torque) required to turn one magnetic structure relative to the other.

Figure 5F:
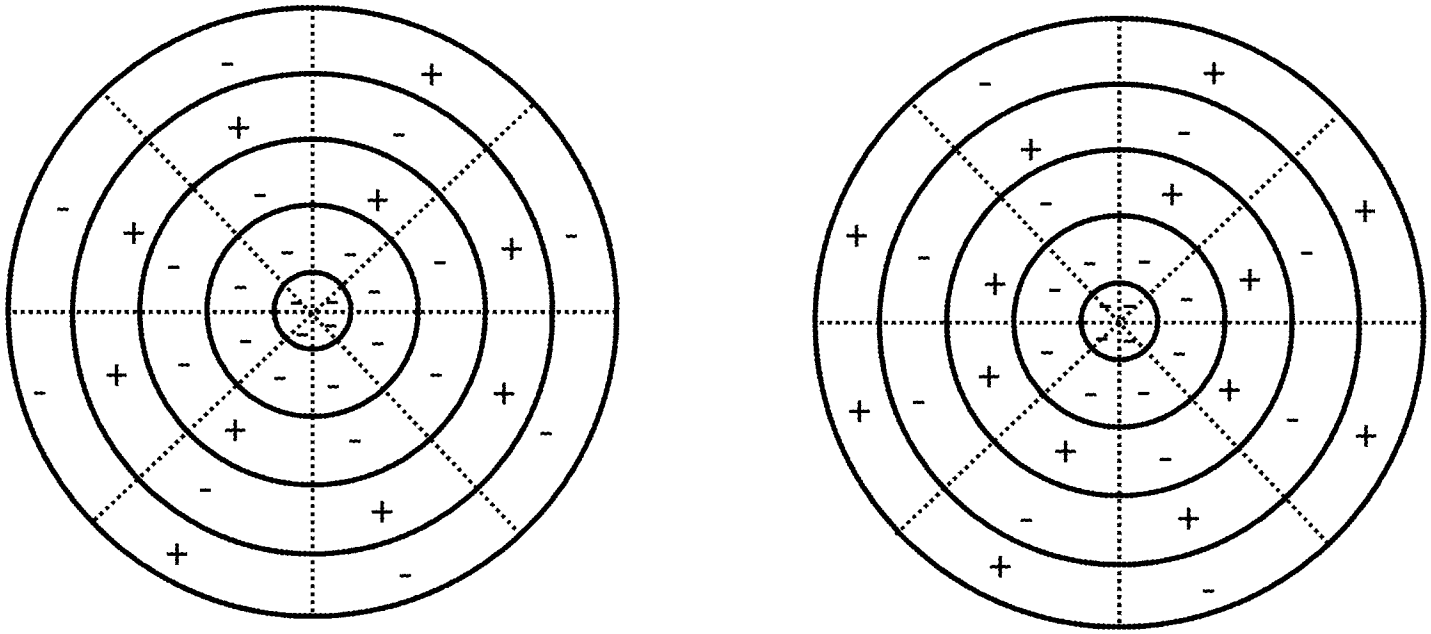
FIG. 5F depicts how portions of the two magnetic structures can be used to provide a bias force.

FIG. 5F illustrates how portions of the two magnetic structures can be used to provide a bias force. As shown, the outer three circles each have two cyclic Barker 4 code modulos and the inner three circles produce a repel bias force regardless of rotation.

Figure 5G:
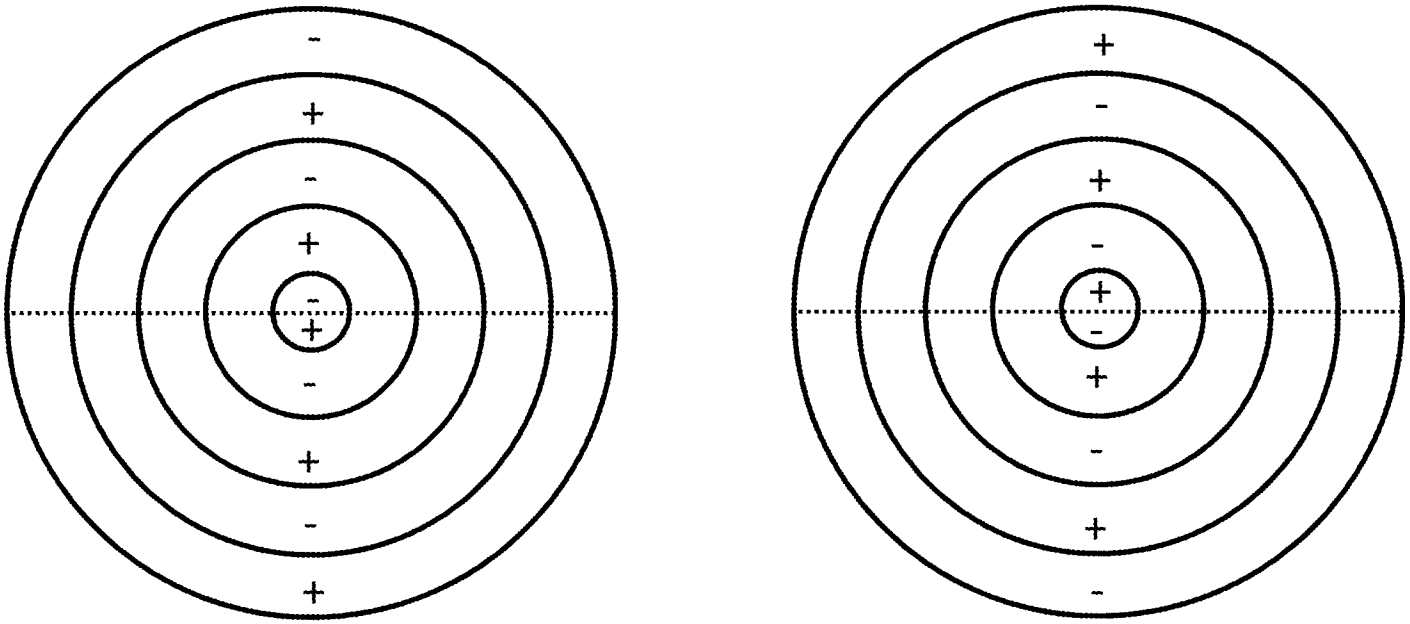
FIG. 5G depicts complementary magnetic structures comprising two halves of alternating polarity arc segments.

FIG. 5G depicts complementary magnetic structures comprising two halves of alternating polarity arc segments. This design will transition from a peak attract force at a peak attract force alignment position to a zero force at =/−90° and will transition from a zero force at +/−90° to a peak repel force at a peak repel force alignment position at +/−180°.

Figure 5H:
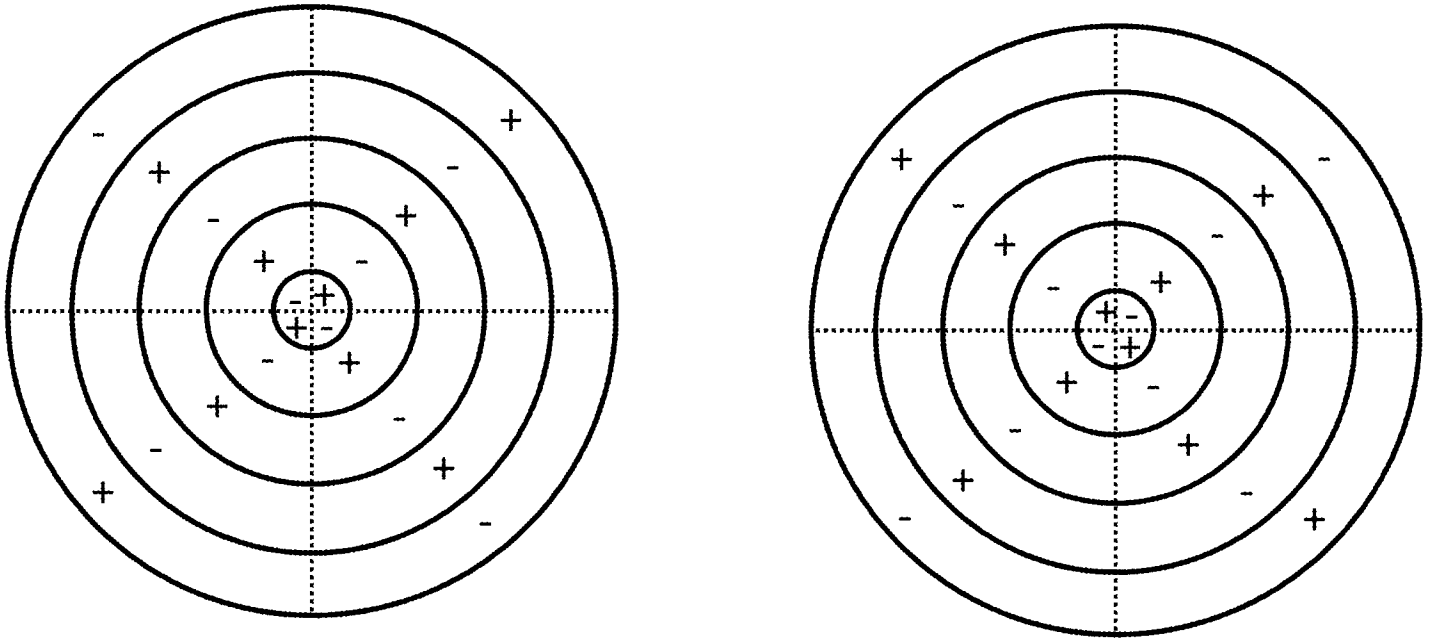
FIG. 5H depicts complementary magnetic structure comprising four alternating polarity quadrants of alternating polarity arc segments.

FIG. 5H depicts complementary magnetic structure comprising four alternating polarity quadrants of alternating polarity arc segments. This design will transition from a peak attract force at a peak attract force alignment position to a zero force at =/−45° and will transition from a zero force at +/−45° to a peak repel force at a peak repel force alignment position at +/−90°, will transition from a peak repel force at +/−45° to zero force at +/−135°, and will transition from a zero force to a attract force at +/−180°.

Figure 5I:
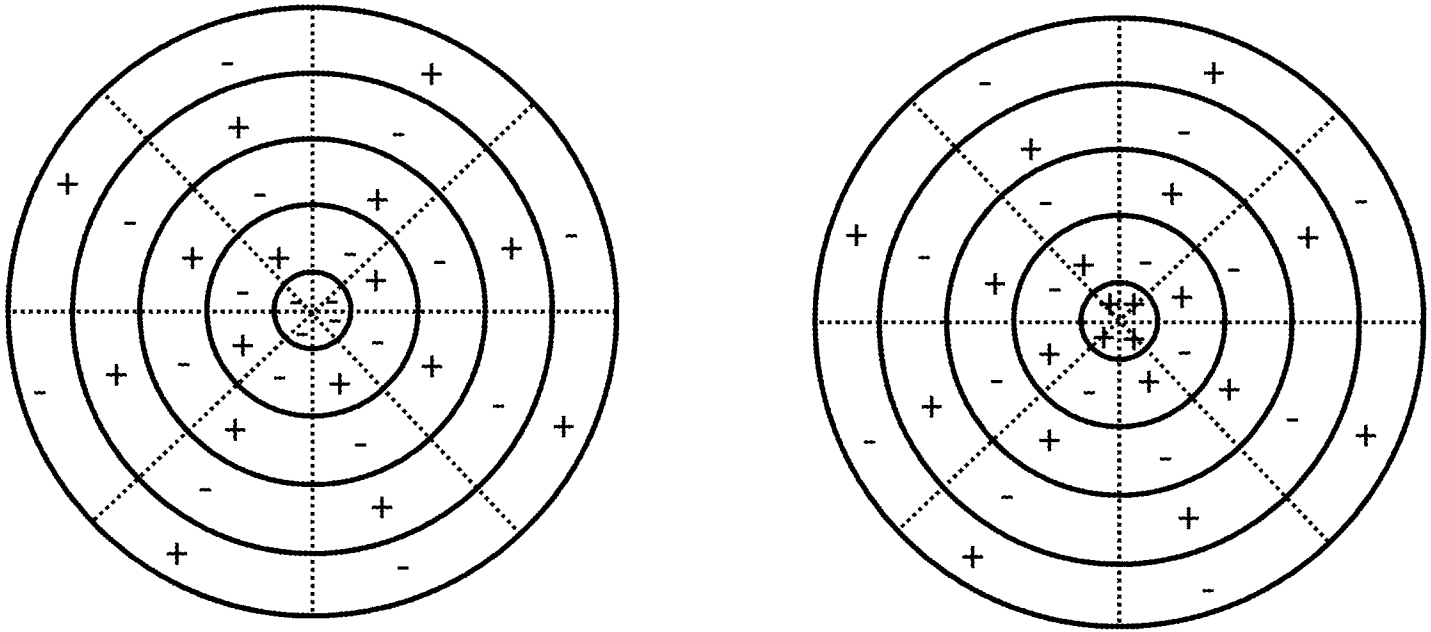
FIG. 5I depicts complementary magnetic structures where the outer four circles comprise eight alternating polarity octants of alternating polarity arc segments and inner most circles that provide an attract bias force.

FIG. 5I depicts complementary magnetic structures where the outer four circles comprise eight alternating polarity octants of alternating polarity arc segments and inner most circles that provide an attract bias force regardless of rotational alignment.

While particular embodiments of the invention have been described, it will be understood, however, that the invention is not limited thereto, since modifications may be made by those skilled in the art, particularly in light of the foregoing teachings.

The invention claimed is:

1. A magnetic attachment system, comprising:

a female component associated with a first object, said female component comprising:

a hole; and a first magnetic structure having a first plurality of magnetic source regions having a first polarity pattern; and a male component associated with a second object, said male component comprising:

a peg that can be inserted into said hole; and a second magnetic structure having a second plurality of magnetic source regions having a second polarity pattern complementary to said first polarity pattern, wherein said male component and said female component are configured such that when said peg is inserted into said hole the first and second magnetic structures face each other across an interface boundary enabling magnetic attachment of said first object to said second object, wherein while said peg remains within said hole said male component can be rotated relative to said female component but translational movement of said male component relative to said female component is constrained, wherein said first polarity pattern and said second polarity pattern are in accordance with a cyclic implementation of a code of length N, wherein said code has a cyclic correlation function having a single peak and a plurality of off peaks per code modulo.

2. The magnetic attachment system of claim 1, wherein said first and second polarity patterns are irregular polarity patterns.

3. The magnetic attachment system of claim 1, wherein said first and second magnetic structures produce a peak attract force when in a complementary rotational alignment position, said peak attract force magnetically attaching said first object to said second object.

4. The magnetic attachment system of claim 1, wherein said first and second magnetic structures produce an off-peak force that is an attract force less than the peak attract force when the male component has been rotated relative to the female component plus or minus 360/N degrees from the complementary rotational alignment position and said cyclic implementation of said code includes only one code modulo of said code.

5. The magnetic attachment system of claim 1, wherein said first and second magnetic structures produce an off-peak force that is a substantially zero force when the male component has been rotated relative to the female component plus or minus 360/N degrees from the complementary rotational alignment position and said cyclic implementation of said code includes only one code modulo of said code.

6. The magnetic attachment system of claim 1, wherein said first and second magnetic structures produce an off-peak force that is a repel force when the male component has been rotated relative to the female component plus or minus 360/N degrees from the complementary rotational alignment position and said cyclic implementation of said code includes only one code modulo of said code.

7. The magnetic attachment system of claim 1, wherein said code is a Barker code.

8. The magnetic attachment system of claim 1, wherein each symbol of said code is implemented with one of a region having a first polarity or a region having a second polarity.

9. The magnetic attachment system of claim 1, wherein each symbol of said code is implemented with an irregular polarity pattern.

10. The magnetic attachment system of claim 1, wherein each symbol of said code is a Barker code.

11. The magnetic attachment system of claim 1, wherein each symbol of said code is implemented with alternating polarity regions.

12. The magnetic attachment system of claim 11, wherein one polarity region is rotated relative to another polarity region.

13. The magnetic attachment system of claim 11, wherein polarities of opposing regions of the first and second magnetic structures are exchanged.

14. The magnetic attachment system of claim 1, wherein one of said first object or said second object is one of a flashlight, a strap, an electronic device, a cell phone, a PDA, a camera, a GPS, a sign, a picture, a fire extinguisher, or a rod holder.

15. The magnetic attachment system of claim 1, wherein one of said first object or said second object is one of a wall, a vehicle, or a garment.

16. The magnetic attachment system of claim 1, wherein at least one of said male component or said female component comprises at least one of attachment holes enabling attachment to at least one of said first object or said second object using a nail or screw, an adhesive enabling attachment to at least one of said first object or said second object, rounded edges, first notches providing a hand grip, at least one marking for identifying one or more alignment positions, or at least one second notch for removing said at least one of said first magnetic structure or said second magnetic structure using a tool.

17. The magnetic attachment system of claim 1, wherein said male component is integrated with said first object.

18. The magnetic attachment system of claim 1, wherein said female component is integrated with said second object.

19. The magnetic attachment system of claim 1, wherein one of said male component or said female component is placed inside a pocket of a garment.

20. The magnetic attachment system of claim 1, wherein one of said male component or said second component is integrated into one of a sleeve, a shoulder portion of a garment, a belt, a hat, a knapsack, or a shoe.

* * * * *